US007994719B2

(12) United States Patent
Muro et al.

(10) Patent No.: US 7,994,719 B2
(45) Date of Patent: Aug. 9, 2011

(54) PLASMA DISPLAY PANEL WITH IMPROVED LUMINANCE

(75) Inventors: Masahiro Muro, Osaka (JP); Tomohiro Okumura, Osaka (JP)

(73) Assignee: Panasonic Corporation, Osaka (JP)

( * ) Notice: Subject to any disclaimer, the term of this patent is extended or adjusted under 35 U.S.C. 154(b) by 532 days.

(21) Appl. No.: 12/093,294

(22) PCT Filed: Oct. 29, 2007

(86) PCT No.: PCT/JP2007/071018

§ 371 (c)(1),
(2), (4) Date: May 9, 2008

(87) PCT Pub. No.: WO2008/053832

PCT Pub. Date: May 8, 2008

(65) Prior Publication Data

US 2009/0267511 A1 Oct. 29, 2009

(30) Foreign Application Priority Data

Oct. 31, 2006 (JP) ..... 2006-295140
Jan. 15, 2007 (JP) ..... 2007-005600

(51) Int. Cl.
*H01J 17/49* (2006.01)

(52) U.S. Cl. ..... 313/586; 313/582; 313/587

(58) Field of Classification Search ..... 313/582–587
See application file for complete search history.

(56) References Cited

U.S. PATENT DOCUMENTS

| | | | | |
|---|---|---|---|---|
| 5,136,207 | A | 8/1992 | Miyake et al. | |
| 5,352,478 | A | 10/1994 | Miyake et al. | |
| 6,369,501 | B1 * | 4/2002 | Aoki et al. | 313/486 |
| 2007/0228955 | A1 | 10/2007 | Moon | |

FOREIGN PATENT DOCUMENTS

| | | |
|---|---|---|
| JP | 2-297837 | 12/1990 |
| JP | 4-47639 | 2/1992 |
| JP | 8-138559 | 5/1996 |
| JP | 8-162019 | 6/1996 |
| JP | 10-188820 | 7/1998 |
| JP | 11-131059 | 5/1999 |
| JP | 11-191368 | 7/1999 |
| JP | 11-213887 | 8/1999 |
| JP | 11-213899 | 8/1999 |
| JP | 2000-149798 | 5/2000 |
| JP | 2000-173456 | 6/2000 |

(Continued)

OTHER PUBLICATIONS

International Search Report issued Dec. 11, 2007 in International (PCT) Application No. PCT/JP2007/071018.

(Continued)

*Primary Examiner* — Joseph L Williams
*Assistant Examiner* — Fatima N Farokhrooz
(74) *Attorney, Agent, or Firm* — Wenderoth, Lind & Ponack, L.L.P.

(57) ABSTRACT

A back face panel in a plasma display panel is provided with barrier-rib portions, fluorescent barrier-rib portions including a mixed material of a barrier-rib material and a phosphor material and formed on side faces thereof, and a phosphor portion including the phosphor material and formed in a manner so as to cover the fluorescent barrier-rib portions, and each of barrier ribs is formed by each barrier-rib portion and each fluorescent barrier-rib portion, while a phosphor layer is formed by each phosphor portion and each fluorescent barrier-rib portion.

1 Claim, 17 Drawing Sheets

FOREIGN PATENT DOCUMENTS

| | | |
|---|---|---|
| JP | 2000-243273 | 9/2000 |
| JP | 2002-42668 | 2/2002 |
| JP | 2003-31135 | 1/2003 |
| JP | 2007-250546 | 9/2007 |

OTHER PUBLICATIONS

International Preliminary Report on Patentability issued Jun. 4, 2009 in the International (PCT) Application No. PCT/JP2007/071018.

* cited by examiner

PLASMA DISPLAY PANEL WITH IMPROVED LUMINANCE

TECHNICAL FIELD

The present invention relates to a method for manufacturing a plasma display panel, and more particularly concerns a method for manufacturing barrier ribs of a back face panel.

BACKGROUND ART

There have been strong demands for a display apparatus using a plasma display panel (hereinafter, referred to as "PDP") as a display apparatus that can display high-quality television images on a large screen.

The PDP has a structure in which a front face panel and a back face panel are placed face to face with each other, with the peripheral portion being sealed by a sealing member, and a discharge gas such as neon and xenon is sealed in discharge spaces formed between the two panels. The front face panel is provided with display electrode pairs formed on one of surfaces of a glass substrate, each pair made up of a scanning electrode and a sustain electrode, and a dielectric layer and a protective layer that cover these electrodes. The back face panel is provided with a plurality of address electrodes formed into a stripe shape in a direction orthogonal to the display electrode pairs on one surface of a glass substrate, an undercoating dielectric layer that covers these address electrodes, barrier ribs that divide the discharge space for each of the address electrodes, and phosphor layers of red, green, and blue colors that are successively coated onto the side faces of each barrier rib and the undercoating dielectric layer.

The display electrode pairs and the address electrodes are made orthogonal to each other, with the intersecting portions formed into discharge cells. These discharge cells are arranged in a matrix shape, and three discharge cells having red, green, and blue phosphor layers aligned in the direction of the display electrode pairs are allowed to form a pixel for use in color display. The PDP successively applies predetermined voltages between the scanning electrodes and the address electrodes as well as between the scanning electrodes and the sustain electrodes to generate gas discharge, and by exciting the phosphor layers by using ultraviolet rays generated by the gas discharge, visible light rays are emitted so that a colored image is displayed.

In recent years, there have been strong demands for miniaturization of discharge cells in response to the development of high precision PDPs. When the size of a discharge cell is made smaller, the discharge space is also made smaller to cause an issue of degradation in the fluorescent luminance. In order to improve the fluorescent luminance in a predetermined size of discharge cells, an attempt has been made to narrow the width of barrier ribs; however, when the width of barrier ribs is made too narrow, an erroneous discharge tends to occur between the adjacent cells and the strength of the barrier ribs tend to deteriorate. Moreover, an attempt has been made to improve the fluorescent luminance by applying the phosphor layer to be formed on the inner walls of the discharge cell with a higher thickness; however, when the thickness of the phosphor is increased, the discharge space becomes smaller to cause a high discharge voltage.

In order to solve the issue of a reduction in the fluorescent luminance, for example, a method has been disclosed in which by using a photosensitive barrier-rib material containing a phosphor, the phosphor is contained in the entire barrier ribs so that the effective phosphor thickness is increased (for example, see Patent Document 1).

Here, for example, another method has been disclosed in which in order to improve the fluorescent luminance of discharge cells by forming a reflective layer on the surface of the barrier ribs, a glass paste layer serving as a first barrier-rib material is formed on a substrate, and after a glass paste layer serving as a white second barrier-rib material containing titania powder or zirconia powder has been formed on the surface thereof, a mold used for forming barrier ribs is pressed onto the surface of the second glass paste layer, and both of the glass paste layers are consequently subjected to plastic deformation so that barrier ribs are formed (for example, see Patent Document 2).

Patent Document 1: Japanese Unexamined Patent Publication No. 11-191368

Patent Document 2: Japanese Unexamined Patent Publication No. 11-213899

DISCLOSURE OF INVENTION

Subject to be Solved by the Invention

However, along with the recent developments of high precision devices, the aspect ratio of the barrier ribs becomes greater, resulting in an issue of insufficient strength when the barrier ribs are formed by the method of Patent Document 1 and an issue of increased number of processes and the subsequent complicated manufacturing processes. In contrast, in the method of Patent Document 2 in which the reflective layer is formed on the surface of the barrier ribs, an issue arises in which the luminance in the fine discharge cells is not sufficiently improved.

The present invention has been devised to solve these issues, and its objective is to provide a PDP that can achieve barrier ribs used for forming fine discharge cells capable of providing high-precision display and high-luminance display, with high precision at low costs, and also to provide a method for manufacturing such a PDP.

Means for Solving the Subject

In order to achieve the above-mentioned objectives, the present invention is provided with the following arrangements.

According to a first aspect of the present invention, there is provided a plasma display panel comprising:

a front face panel prepared by forming paired display electrodes, a dielectric layer, and a protective layer on a glass substrate; and a back face panel prepared by forming address electrodes, barrier ribs, and phosphor layers on a substrate, with the front face panel and the back face panel being made face to face with each other to form discharge spaces by sealing peripheral portions thereof, wherein fluorescent barrier-rib portions are placed between the barrier ribs and each of the phosphor layers, with the fluorescent barrier-rib portions comprising a mixed material of a barrier-rib material and a phosphor material.

In accordance with this structure, it becomes possible to achieve barrier ribs having sufficient barrier-rib strength even in the case of fine discharge cells, and consequently to achieve a PDP having higher luminance.

According to a second aspect of the present invention, there is provided the plasma display panel according to the first aspect, wherein the fluorescent barrier-rib portions comprise a mixed material of the phosphor material and the barrier-rib material, with the phosphor material having a mixed ratio in a range of from 42 wt % to 67 wt %.

In accordance with this structure, it is possible to increase the fluorescent luminance while properly maintaining the strength of the barrier ribs.

According to a third aspect of the present invention, there is provided a method for manufacturing a plasma display panel which is provided with: a front face panel prepared by forming paired display electrodes, a dielectric layer, and a protective layer on a glass substrate; and a back face panel prepared by forming address electrodes, barrier ribs, and a phosphor layer on a substrate, with the front face panel and the back face panel being made face to face with each other to form discharge spaces by sealing peripheral portions thereof, comprising the steps of:

applying a barrier-rib material to the address electrodes so as to be covered therewith to form a barrier-rib portion-forming layer;

forming a fluorescent barrier-rib portion-forming layer at positions on the barrier-rib portion-forming layer that correspond to positions of the address electrodes by using a mixed material of a barrier-rib material and a phosphor material;

simultaneously pressing the fluorescent barrier-rib portion-forming layer and the barrier-rib portion-forming layer by using a forming mold having female concave portions corresponding to a pattern of the barrier ribs to mold the barrier ribs;

releasing the forming mold from the fluorescent barrier-rib portion-forming layer and the barrier-rib portion-forming layer;

firing and solidifying the fluorescent barrier-rib portion-forming layer and the barrier-rib portion-forming layer molded by the forming mold to form barrier ribs and fluorescent barrier-rib portions; and forming phosphor portions comprising a phosphor material in a manner so as to cover the fluorescent barrier-rib portions, thus manufacturing the back face panel.

In accordance with this manufacturing method, in the molding step, the barrier-rib portions comprising only the barrier-rib material are formed, and the fluorescent barrier-rib portions containing a phosphor material and the barrier-rib material are formed on the side faces of each of the barrier-rib portions; thus, it becomes possible to easily manufacture barrier ribs that can ensure sufficient barrier-rib strength and also improve the luminance.

According to a fourth aspect of the present invention, there is provided the method for manufacturing a plasma display panel according to the third aspect, wherein in the molding step, by simultaneously pressing the fluorescent barrier-rib portion-forming layer and the barrier-rib portion-forming layer by using the forming mold, with a flowability of the material for forming the fluorescent barrier-rib portion-forming layer in response to a stress application being made smaller than a flowability of the material for forming the barrier-rib portion-forming layer in response to a stress application, each of the female-mold concave portions is filled with the material for forming the barrier-rib portion-forming layer to form a barrier-rib core portion of the barrier rib while the material for forming the fluorescent barrier-rib portion-forming layer forms fluorescent barrier-rib portions on two side-wall portions of the barrier-rib core portion.

In accordance with this manufacturing method, the fluorescent barrier-rib portions can be formed on the entire surfaces of the side faces of the core portion of each of the barrier ribs, without causing the material for the core portion of each barrier rib and the fluorescent barrier-rib forming layer to be mixed with each other.

According to a fifth aspect of the present invention, there is provided the method for manufacturing a plasma display panel according to the fourth aspect, further comprising the steps of:

forming a phosphor portion-forming layer on the fluorescent barrier-rib portion;

simultaneously pressing the phosphor portion-forming layer, the fluorescent barrier-rib portions, and the barrier-rib portion-forming layer by using the forming mold having the female concave portions corresponding to the pattern of the barrier ribs to carry out molding;

releasing the forming mold from the barrier ribs, the fluorescent phosphor barrier portions, and the phosphor portion-forming layer; and firing and solidifying the barrier ribs, the fluorescent barrier-rib portions, and the phosphor portion-forming layer molded by the forming mold.

In accordance with this manufacturing method, by carrying out a molding step only once, the core portion comprising only the barrier-rib material is formed, and the fluorescent barrier-rib portions containing a phosphor material and the barrier-rib material and the phosphor portions comprising only the phosphor material are formed on the side faces thereof so that it is possible to manufacture discharge cells having improved luminance, with sufficient barrier-rib strength being maintained.

According to a sixth aspect of the present invention, there is provided the method for manufacturing a plasma display panel according to the fifth aspect, wherein by simultaneously pressing the phosphor portion-forming layer, the fluorescent barrier-rib portion-forming layer, and the barrier-rib portion-forming layer by using the forming mold, with the flowability of the phosphor portion-forming layer in response to the stress application being made smaller than the flowability of the fluorescent barrier-rib portions in response to the stress application, each of the female-mold concave portions is filled with the material for forming the barrier-rib portion-forming layer to form the barrier-rib core portion of the barrier rib while the material for forming the fluorescent barrier-rib portion-forming layer forms the fluorescent barrier-rib portions on the two side-wall portions of the barrier-rib core portion and the material for forming the phosphor portion-forming layer further forms the phosphor portion-forming layer on each of the fluorescent barrier rib portions.

In accordance with this manufacturing method, the phosphor portion-forming layer can be formed over the entire faces of the side faces of the fluorescent barrier-rib portion-forming layer in the molding process.

According to a seventh aspect of the present invention, there is provided the method for manufacturing a plasma display panel according to any one of the third to sixth aspects, wherein the fluorescent barrier-rib portions comprise a mixed material of the phosphor and the barrier-rib material, with the phosphor material having a mixed ratio in a range of from 42 wt % to 67 wt %.

In accordance with this manufacturing method, it becomes possible to improve the fluorescent luminance, with the strength of the barrier ribs being sufficiently maintained.

According to an eighth aspect of the present invention, there is provided a method for manufacturing a plasma display panel which is provided with: a front face panel prepared by forming paired display electrodes, a dielectric layer, and a protective layer on a glass substrate; and a back face panel prepared by forming barrier ribs and a phosphor layer on a substrate, with the front face panel and the back face panel being made face to face with each other to form discharge spaces by sealing peripheral portion thereof, comprising the steps of:

applying a fluorescent assistant material composition containing a barrier-rib material and a fluorescent assistant material onto one of side faces of each of concave portions of a forming mold having the concave portions corresponding an inverted pattern to the barrier ribs so as to form a fluorescent assistant material layer;

filling a void in a center of each of the concave portions with a barrier-rib material composition so as to form a barrier-rib forming layer;

making the substrate in contact with the forming mold so that the substrate and the barrier-rib material composition are bonded to each other;

curing the fluorescent assistant material composition and the barrier-rib material composition;

releasing the forming mold from the fluorescent assistant material composition and the barrier-rib material composition;

firing and solidifying the barrier-rib material composition and the fluorescent assistant material composition so that barrier-rib portions are formed by the barrier-rib material composition while fluorescent barrier-rib portions are formed by the fluorescent assistant material composition; and forming phosphor portions comprising a phosphor material in a manner so as to cover the fluorescent barrier-rib portions.

In accordance with this manufacturing method, the luminance is improved by the fluorescent assistant material (fluorescent barrier-rib portions) that is exposed to the surface portion of each barrier rib after the firing process, and since the center portion of the barrier rib comprises only the barrier-rib material, the strength of the barrier rib itself can be sufficiently maintained.

According to a ninth aspect of the present invention, there is provided the method for manufacturing a plasma display panel according to the eighth aspect, wherein in the step of forming the fluorescent assistant material layer, the fluorescent assistant material composition is applied in a state in which an oil repellent treatment has been carried out on a bottom face of each of the concave portions.

With this method, in the fluorescent assistant material forming step in which the fluorescent assistant material composition is applied to one of the side faces of each concave portion, the coating process is carried out only on the side faces with high precision because of repellence exerted on the concave portion bottom face having an oil repellent property.

According to a 10th aspect of the present invention, there is provided the method for manufacturing a plasma display panel according to the eighth or ninth aspect, wherein in the step of forming the fluorescent assistant material layer, the fluorescent assistant material composition is applied in a state in which a lipophilic treatment has been carried out on the side-face portions of each of the concave portions.

With this arrangement, in the fluorescent assistant material forming step, since the fluorescent assistant material composition is allowed to have an affinity for the side faces of each concave portion, the coating process is stably carried out on the side faces.

According to an 11th aspect of the present invention, there is provided the method for manufacturing a plasma display panel according to the eighth aspect, further comprising the steps of:

prior to the step of forming the fluorescent assistant material layer, filling the concave portions with a barrier-rib material composition; and forming a gap used for forming a fluorescent assistant material layer between the filled barrier-rib material composition and the side-face portions of each of the concave portions, wherein in the step of forming the fluorescent assistant material layer, the fluorescent assistant material composition is applied so as to be inserted into the gap for forming a fluorescent assistant material layer.

With this manufacturing method, it is possible to positively form the barrier-rib material onto the center portion of each barrier rib and consequently to enhance the strength of the barrier rib.

According to a 12th aspect of the present invention, there is provided the method for manufacturing a plasma display panel according to the eighth aspect, wherein the forming mold is constituted by a first forming mold for molding the side-face portions of each of the concave portions and a second forming mold having an end portion used for molding a bottom face of each of the concave portions, which is fitted and inserted into the first forming mold, and the fluorescent assistant material forming step is carried out, with the end portion of the second forming mold being placed above a position of the bottom face of each of the concave portions corresponding an inverted pattern to the barrier ribs, and the step of forming the barrier-rib portion-forming layer is then carried out, with the end portion of the second forming mold being placed at the position of the bottom face of each of the concave portions corresponding an inverted pattern to the barrier ribs.

With this manufacturing method, in the fluorescent assistant material forming step, the fluorescent assistant material composition can be positively applied to one of the side faces of each concave portion by using the second forming mold, while it is hardly applied to the bottom portion and the other side face on the opposing side of each concave portion; thus, it becomes possible to carry out the coating process only on the slanted side face with high precision.

According to a 13th aspect of the present invention, there is provided the method for manufacturing a plasma display panel according to the 12th aspect, wherein in the step of forming the fluorescent assistant material layer, the fluorescent assistant material composition is applied in a state in which an oil repellent treatment has been carried out on a surface of the second forming mold used for forming the concave portions.

In accordance with this arrangement, since the oil repellent treatment is carried out on the surface of the second forming mold used for forming the concave portion, the fluorescent assistant material composition to be applied to one of the side faces of each concave portion in the fluorescent assistant material forming step is made repellent against the surface of the second forming mold so that it is hardly applied to the side face on the opposing side of each concave portion; thus, it becomes possible to carry out the coating process only on the slanted side face with high precision.

According to a 14th aspect of the present invention, there is provided the method for manufacturing a plasma display panel according to any one of the eighth, ninth, 11th to 13th aspects, wherein the fluorescent assistant material contains at least one material selected from a phosphor material and a reflective pigment.

With this arrangement, since the fluorescence of the phosphor layer can be assisted more positively, it becomes possible to manufacture a PDP with high luminance.

EFFECTS OF THE INVENTION

As described above, according to the present invention, since a portion comprising the mixed material of both of the barrier-rib material and the phosphor material is prepared, the corresponding portion is allowed to exert both of the function as the barrier rib and the function as the phosphor so that it is possible to achieve a barrier-rib structure of a PDP that can increase the effective phosphor thickness while properly maintaining the barrier-rib strength, and a manufacturing method for such a barrier-rib structure, and consequently to realize a PDP having fine discharge with high precision and high luminance. Moreover, since the portion comprising the mixed material of both of the barrier-rib material and the phosphor material is prepared, the effect for restraining the separation between the portion (barrier ribs) comprising the barrier-rib material and the portion (phosphor layer) comprising the phosphor material can be expected.

BRIEF DESCRIPTION OF DRAWINGS

These and other aspects and features of the present invention will become clear from the following description taken in conjunction with the preferred embodiments thereof with reference to the accompanying drawings, in which.

BEST MODE FOR CARRYING OUT THE INVENTION

Figure 1A:
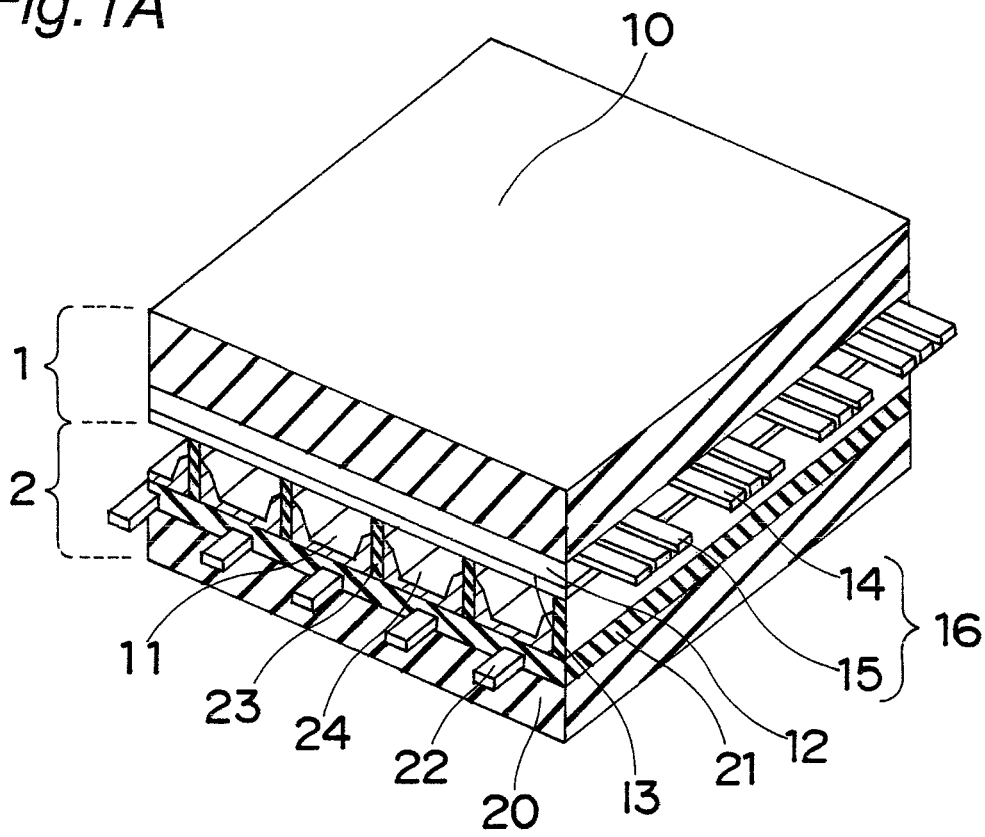
FIG. 1A is a perspective view showing an essential portion of a PDP according to a first embodiment of the present invention.

Before the description of the present invention proceeds, it is to be noted that like parts are designated by like reference numerals throughout the accompanying drawings.

Hereinafter, a first embodiment in the present invention will be discussed in detail with reference to the drawings.

Referring to the drawings, embodiments of the present invention will be described below.

First Embodiment

FIG. 1A is a perspective view showing an essential portion of a PDP according to the first embodiment of the present invention. This PDP has a structure in which a plurality of discharge cells 11 serving as discharge spaces are formed in a matrix shape between a front face panel 1 and a back face panel 2 placed opposite to each other, and the peripheral portion of each discharge cell 11 is sealed by a sealing member (not shown) such as glass frit.

On a front face substrate 10 forming the front face panel 1, a plurality of paired display electrodes 16, constituted by scanning electrodes 14 and sustain electrodes 15 covered with a dielectric layer 12 and a protective layer 13, are arranged in parallel with one another. Each of the paired display electrodes 16 is constituted by a transparent electrode that transmits visible light and a bus electrode used for lowering the resistance of the transparent electrode.

On the other hand, on a back face substrate 20 forming the back face panel 2, a plurality of address electrodes 22 covered with an undercoating dielectric layer 21 are arranged in parallel with one another in a direction orthogonal to the paired display electrodes 16. Barrier ribs 23, used for separating the discharge cells 11 for each address electrode 22, are formed between the adjacent address electrodes 22. Moreover, a phosphor layer 24 is formed on the undercoating dielectric layer 21 as well as on the side faces of each barrier rib 23.

Figure 1B:
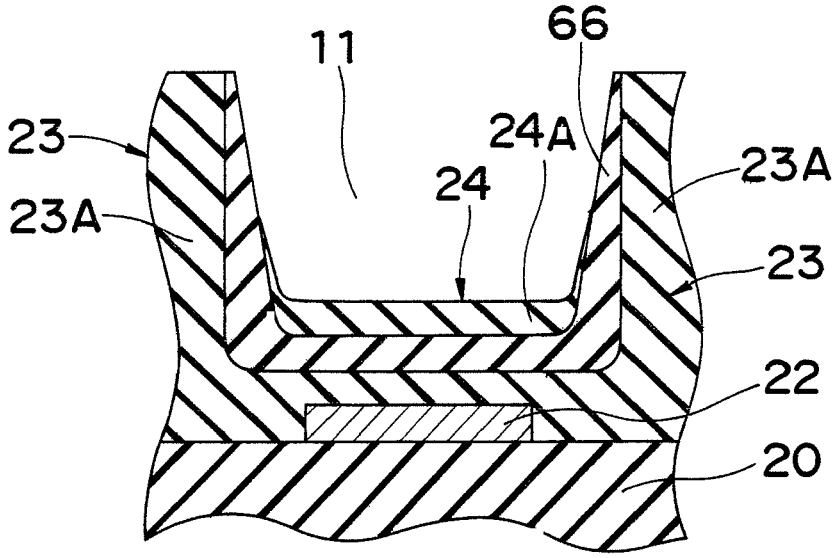
FIG. 1B is an enlarged cross-sectional view showing a discharging cell in the PDP of the first embodiment of the present invention.

Meanwhile, although not shown in FIG. 1A, as shown in FIG. 1B, a fluorescent barrier-rib portion 66 is placed between each barrier rib 23 and the phosphor layer 24, and the fluorescent barrier-rib portion 66 is formed by a mixed material of a barrier-rib material and a phosphor material. The barrier rib 23 is configured by a barrier-rib portion 23A formed only by the barrier-rib material and the portion made by the barrier-rib material of the fluorescent barrier-rib portion 66, which is formed on the side faces of the barrier rib 23 by using the mixed material of the barrier-rib material and the phosphor material.

The phosphor layer 24 is constituted by the portion of the phosphor material of the fluorescent barrier-rib portion 66 and a phosphor portion 24A formed only by the phosphor material in a manner so as to cover the fluorescent barrier-rib portion 66.

Here, the barrier-rib portion 23A, the fluorescent barrier-rib portion 66, and the phosphor portion 24A form three structural portions with respective clear borders, but the border lines are not necessarily formed linearly, and have arbitrary shapes such as a straight line, a curved line, and a zig-zag line; however, for convenience of easy understanding of the present embodiment, these are simplified, and linearly illustrated in FIGS. 1A, 1B and the like. That is, the fluorescent barrier-rib portion 66 is formed on the barrier-rib portion 23A intentionally in a manner so as to cover the barrier-rib portion 23A, and there is a clear border between the fluorescent barrier-rib portion 66 and the barrier-rib portion 23A. Moreover, there is a clear border between the fluorescent barrier-rib portion 66 and the phosphor portion 24A as well. After completion of the panel, the barrier-rib material is fused, but since the phosphor material remains as powder, as it is, the respective borders can be recognized when the cross section is observed. It can also be said that, in the barrier rib 23, the barrier-rib portion 23A functions as the barrier-rib main body portion, while the above-mentioned fluorescent barrier-rib portion 66 functions as a barrier-rib assistant portion. Moreover, it can also be said that, in the phosphor layer 24, the phosphor portion 24A functions as the phosphor-layer main body portion, while the fluorescent barrier-rib portion 66 serves as a phosphor-layer assistant portion. Consequently, the above-mentioned fluorescent barrier-rib portion 66 has both of functions, that is, the function as the barrier-rib assistant portion and the function as the phosphor-layer assistant portion.

For example, a gas, such as a neon gas and a xenon gas, is sealed in the discharge cell 11 as a gas that emits ultraviolet rays through discharging. The phosphor layer 24 (that is, the phosphor material in the fluorescent barrier-rib portion 66 and the phosphor material in the phosphor portion 24A) is excited by the ultraviolet rays generated by the discharge inside the discharge cell 11 so that visible light is generated to display an image. As described above, the PDP has the structure in which the discharge cells 11, arranged in a matrix shape, form an image display area, with the various electrodes being formed on the surface opposing to the front face substrate 10 and the surface opposing to the back face substrate 20, and by applying various driving voltages to these electrodes from external driving circuits, an image is displayed.

As an example, the barrier rib 23 is designed into a trapezoidal shape in its cross section with 120 μm in height, 35 μm in upper bottom area, 50 μm in lower bottom area, and 220 μm in pitch. However, the present invention is not intended to be limited by these designed values, and the shape of the barrier ribs 23 may be formed into a lattice shape, a stripe shape, or the like. In addition, with respect to the base member of a forming mold 131, not particularly limited, a material, such as plastics, metal, ceramics, or glass, may be used.

Next, a manufacturing method for the back face panel 2 will be described in detail. FIGS. 2A to 2F are views showing manufacturing processes for the back face panel 2 of the PDP according to the first embodiment of the present invention.

Figure 2A:
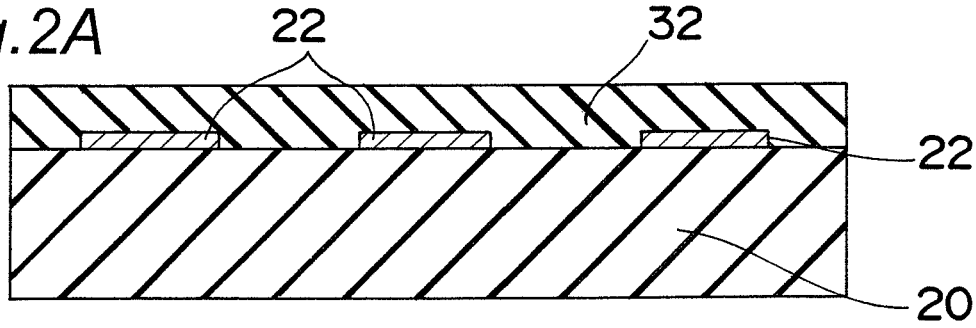
FIG. 2A is a view showing a manufacturing process of a back face panel in the PDP of the first embodiment of the present invention.

FIG. 2A shows processes in which, onto a back face substrate 20 on which the address electrodes 22 are formed, a barrier-rib portion-forming layer 32, used for forming a barrier-rib portion 23A comprising a barrier-rib material as one portion of the barrier rib 23, is applied and formed. After a plurality of the address electrodes 22 have been formed on the back face substrate 20 in a stripe shape, a paste-state barrier-rib material, made of glass, paste, is applied onto the back face substrate 20 evenly in a manner so as to cover the address electrodes 22 so that the barrier-rib portion-forming layer 32 is formed thereon. The barrier-rib portion-forming layer 32 is formed so as to have a thickness to provide an amount required for formation of the barrier-rib portion 23A and the undercoating dielectric layer 21. A die-coater, a screen printing method, or the like is used as the coating method for the barrier-rib material. For example, when glass paste having a viscosity of the range of from 1 Pa·S to 500 Pa·S as the barrier-rib material is used, the barrier-rib portion 23A is easily formed.

The barrier-rib material for forming the barrier ribs 23, for example, includes metal oxides, such as boron oxide, silicon oxide, bismuth oxide, lead oxide, or titanium oxide, and the resulting material forms the barrier ribs 23 when fused through a firing process.

Figure 2B:
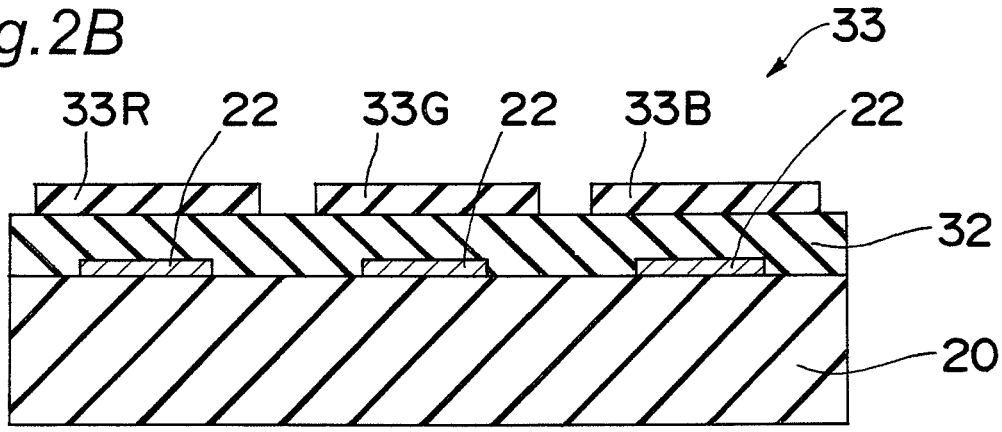
FIG. 2B is a view showing a manufacturing process of the back face panel in the PDP of the first embodiment of the present invention, which follows the process of FIG. 2A.

Next, following the process for coating and forming the barrier-rib portion, as shown in FIG. 2B, a paste-state phosphor-containing-barrier-rib material, prepared by dispersing phosphor powder in glass paste, is applied onto the barrier-rib portion-forming layer 32 so that a portion of the barrier-rib material of the fluorescent barrier-rib portion 66 is formed as one portion of the barrier rib 23 and so that a portion of the phosphor material of the fluorescent barrier-rib portion 66 is formed as one portion of the phosphor layer 24; thus, a process for forming the fluorescent barrier-rib portion-forming layer 33 prepared for forming the fluorescent barrier-rib portion 66 is carried out. The fluorescent barrier-rib portion-forming layer 33 is constituted by fluorescent barrier-rib portion-forming layers 33R, 33G, and 33B for red, green, and blue colors that are respectively formed by phosphor-containing barrier rib materials of red, green, and blue colors that respectively contain phosphors having different fluorescent colors of red, green, and blue. In association with discharge cells 11 for red, green, and blue colors, red, green, and blue phosphor containing barrier-rib materials, which contain phosphors having different fluorescent colors of red, green, and blue, are successively applied thereon in a stripe shape by using a dispenser method, a screen printing method, or the like so that the fluorescent barrier-rib portion-forming layers 33R, 33G, and 33B for red, green, and blue colors are formed. Here, the gap between the stripes of the respective colors is set to less than the width of the partition wall 23 after the completion. Moreover, in the first embodiment of the present invention, the barrier ribs 23 are formed into a stripe shape; however, barrier ribs, formed into "a number sign" shape ("#" shape), may also be used. Here, even in the case of the barrier ribs having "the number sign" shape ("#" shape), when the discharge cells having the same fluorescent color are formed into a stripe shape, the phosphor-containing barrier-rib materials may be applied thereto in a stripe shape.

The phosphor-containing barrier-rib material contains a phosphor material and a barrier-rib material, and in addition to these, a solvent and an organic additive, etc. are added thereto. The barrier-rib material comprises a metal oxide or the like, such as boron oxide, silicon oxide, bismuth oxide, lead oxide, or titanium oxide, and formed into the barrier ribs 23 when fused by firing. Specific examples of the phosphor material are shown below: The blue color phosphor material includes a phosphor material, such as ZnS:Ag, $BaMgAl_{10}O_{17}$:Eu, $BaMgAl_{14}O_{23}$:Eu or $BaNgAl_{16}O_{26}$:Eu. The green color phosphor material includes a phosphor material, such as ZnS:Cu, $Zn_2SiO_4$:Mn, $Y_2O_2S$:Tb or $YBO_3$:Tb. The red color phosphor material includes a phosphor material, such as $Y_2O_3$:Eu, $Zn_3(PiO_4)_2$:Mn, $YVO_4$:Eu or (Y, Gd)$BO_3$:Eu.

When the fluorescent barrier-rib portion-forming layer 33 is thin, the thickness of the fluorescent barrier-rib portion 66 to be formed on each of the two side faces of the wall of the barrier-rib portion 23A also becomes thin, resulting in the possibility that the strength of the barrier rib 23 including the barrier-rib portion 23A in combination with the fluorescent barrier-rib portion 66 might be lowered too much. Therefore, in order to make the thickness of the fluorescent barrier-rib portion 66 to have the thickness of 5 μm or more at the middle portion between the top and the bottom portions of the finished fluorescent barrier rib 23, the thickness of the coated fluorescent barrier-rib portion-forming layer 33 is preferably controlled.

Figure 2C:
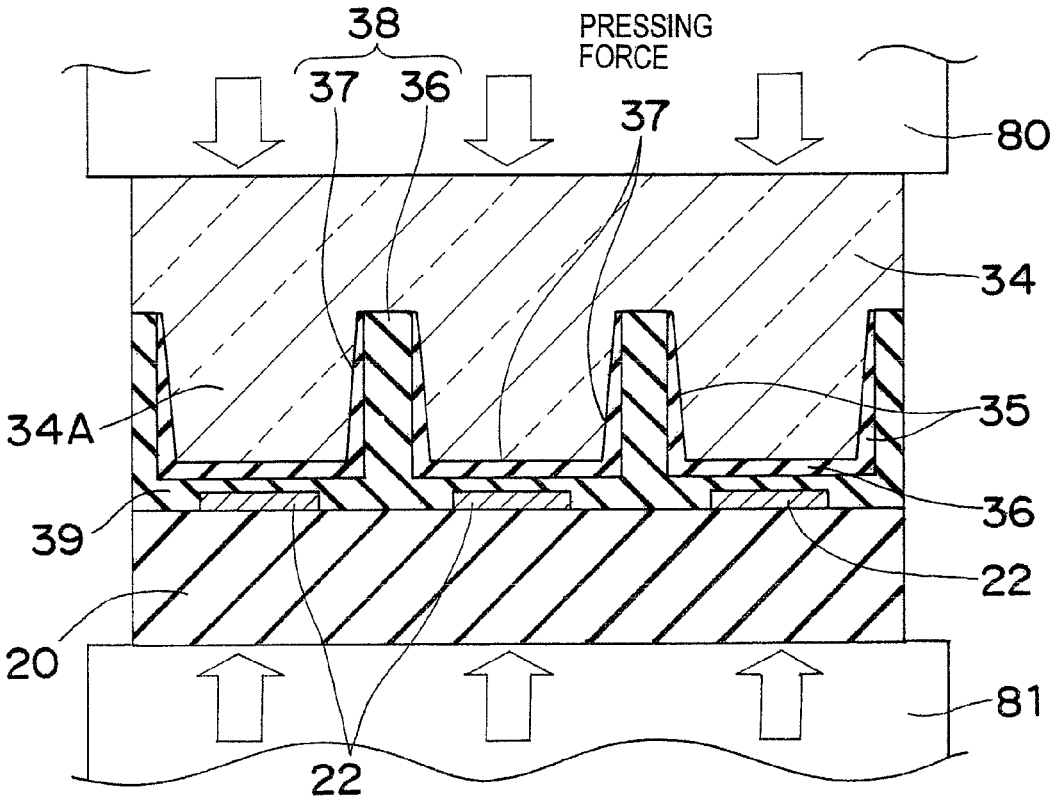
FIG. 2C is a view showing a manufacturing process of the back face panel in the PDP of the first embodiment of the present invention, which follows the process of FIG. 2B.

Next, following the process for forming the fluorescent barrier-rib portion-forming layer 33, FIG. 2C shows processes in which a light-transmitting forming mold 34 is pressed onto the barrier-rib portion-forming layer 32 and the fluorescent barrier-rib portion-forming layer 33 of the back face substrate 20 so that the shape of the forming mold 34 is copied onto the barrier-rib portion-forming layer 32 and the fluorescent barrier-rib portion-forming layer 33. At least within the image display area, the forming mold 34 is formed into an inverted shape to the barrier ribs 23, that is, portions corresponding to the barrier ribs 23 are formed into female-mold concave portions 35, and it is also formed into an inverted shape to the discharge cells 11, that is, portions corresponding to the discharge cells 11 are formed into male-mold convex portions 34A. In this case, however, since the barrier ribs 23 of a finished PDP is in a state after having been fired and solidified, the shape of the female-mold concave portion 35 of the forming mold 34 (in other words, the shape of the male-mold convex portion 34A) is set to a dimension determined by taking into consideration a contraction of the barrier ribs 23 by a firing process after the molding process thereof. The forming mold 34 is positioned onto the back face substrate 20 on which the forming processes up to the fluorescent barrier-rib portion-forming layer 33, shown in FIG. 2B, have been finished, with the center of the female-mold concave portion 35 of the forming mold 34 being positioned in the center of the gap portion between the adjacent address electrodes 22 on the back face substrate 20 (in other words, the center of each male-mold convex portion 34A being positioned in the center of each of the address electrodes 22 on the back face substrate 20), and by pressing the forming mold 34 onto the back face substrate 20 on the base plate 81 in a direction of an arrow in FIG. 2C by using a pressing member 80, the barrier ribs 23 and the discharge cells 11 can be formed at predetermined positions on the back face substrate 20.

By pressing the forming mold 34 onto the back face substrate 20, the end face of the male-mold convex portion 34A of the forming mold 34 is allowed to press the barrier-rib portion-forming layer 32 and the fluorescent barrier-rib portion-forming layer 33 so that along the side face of the female-mold concave portion of the forming mold 34, the material to form the barrier-rib portion-forming layer 32 and the material to form the fluorescent barrier-rib portion-forming layer 33 are allowed to flow into the female-mold concave portion 35. In the first embodiment of the present invention, the flowability of the material to form the fluorescent barrier-rib portion-forming layer 33 in response to a stress application is made smaller than the flowability of the material to form the barrier-rib portion-forming layer 32 in response to a stress application.

The flowability of each of the barrier-rib portion-forming layer 32 and the fluorescent barrier-rib portion-forming layer 33 in response to the stress application is controllable by adjusting the compounding ratio of a resin material into the materials. As a result of this arrangement that makes the material for forming the fluorescent barrier-rib portion-forming layer 33 and the material for forming the barrier-rib portion-forming layer 32 different from each other in their flowability, the first embodiment of the present invention allows the material to form the barrier-rib portion-forming layer 32 to more easily flow to be deformed, in comparison with the material to form the fluorescent barrier-rib portion-forming layer 33 that flows along the surface of the female-mold concave portion 35 of the forming mold 34, by the pressing process of the forming mold 34. For this reason, the material to form the barrier-rib portion-forming layer 32 flows to be deformed so as to form the barrier-rib core portion 36, and intrudes in the female-mold concave portion 35 down to the bottom of the female-mold concave portion 35 so that the fluorescent barrier-rib portion-forming layer 33 having a smaller flowability is molded to be positioned on the periphery of the barrier-rib core portion 36 as well as on the bottom face of the discharge cell 11. Therefore, even by the pressing process of the forming mold 34, the barrier-rib portion-forming layer 32 and the fluorescent barrier-rib portion-forming layer 33 are not mixed with each other, and it is possible to prevent a fluorescent barrier-rib portion-forming layer 33 having another color from being directed into the adjacent discharge cell over the barrier-rib core portion 36 to cause a mixed color.

Therefore, in the center portion inside the female-mold concave portion 35, a barrier-rib core portion 36 made of only the barrier-rib portion-forming layer 32 is formed, and a fluorescent barrier-rib portion-forming layer 33 prior to the firing process, that is, a base fluorescent barrier-rib portion 37, which contains a phosphor material having a different color and a barrier-rib material and is used for forming a fired fluorescent barrier-rib portion 66, is formed on the surface side of the female-mold concave portion 35, that is, on the two side walls of the barrier rib core portion 36 as well as on the bottom of the discharge cell 11. That is, the barrier-rib core portion 36 and the base fluorescent barrier-rib portion 37 that covers the barrier-rib core portion 36 are formed so that a barrier-rib portion-forming layer prior to the firing, that is, a base barrier rib 38 to be used for forming a fired barrier rib 23, can be formed. Since the material used for forming the fluorescent barrier-rib portion-forming layer 33 exerts a small flowability even upon application of a stress, the base fluorescent barrier-rib portion 37 becomes gradually thinner in its film thickness toward the top of the base barrier rib 38. Moreover, the base fluorescent barrier rib 37 may be adjusted in its material for the fluorescent barrier-rib portion-forming layer 33 so that its rate of the barrier-rib material made of a glass paste is gradually increased toward the top of the base barrier rib 38, with the result that only the barrier-rib material is filled in the vicinity of the top of the base barrier rib 38. That is, the materials in the fluorescent barrier-rib portion-forming layer 33 may be adjusted so that the flowability of the barrier-rib material becomes higher in comparison with that of the phosphor material.

In contrast, as the phosphor content of the base barrier rib 38 becomes higher, the improvement of the fluorescent luminance in the discharge cell 11 is expected; however, as the phosphor content of the barrier rib 23 becomes higher, the strength of the barrier rib 23 is lowered. In the first embodiment of the present invention, the mixed ratio between the barrier-rib material and the phosphor material in the fluorescent barrier-rib portion-forming layer 33 is adjusted so that the phosphor material is set to 42 wt % to 67 wt % relative to the weight of the entire materials of the fluorescent barrier-rib portion-forming layer 33; thus, a barrier rib 23, which has a comparatively higher fluorescent luminance even in a miniaturized discharge cell 11, and exerts a barrier-rib strength and elastic modulus that can withstand practical use, is achieved. That is, when the phosphor content is less than 42 wt %, the improvement of the fluorescent luminance in the discharge cell 11 is not expected, while in the case of the phosphor content exceeding 67 wt %, the strength of the barrier rib 23 is undesirably lowered. Therefore, by setting the phosphor content to 42 wt % or more, the improvement of fluorescent luminance in the discharge cell 11 can be expected, and by also setting the phosphor content to 67 wt % or less, it becomes possible to provide sufficient strength and elastic modulus that allow the barrier rib 23 to withstand practical use.

Moreover, simultaneously as the base barrier rib 38 is formed, a remaining portion other than the portion that has flowed therein to form the barrier-rib core portion 36 of the material for forming the barrier-rib portion-forming layer 32 is left between the male-mold convex portion 34A of the forming mold 34 and the back face substrate 20, and this remaining portion of the material for forming the barrier-rib portion-forming layer 32 is used for forming an undercoating dielectric layer forming layer prior to a firing process, that is, a base undercoating dielectric layer 39 for use in forming an undercoating dielectric layer 21 after the firing process. The base undercoating dielectric layer 39 is formed with a thickness that can at least cover the address electrodes 22.

Figure 2D:
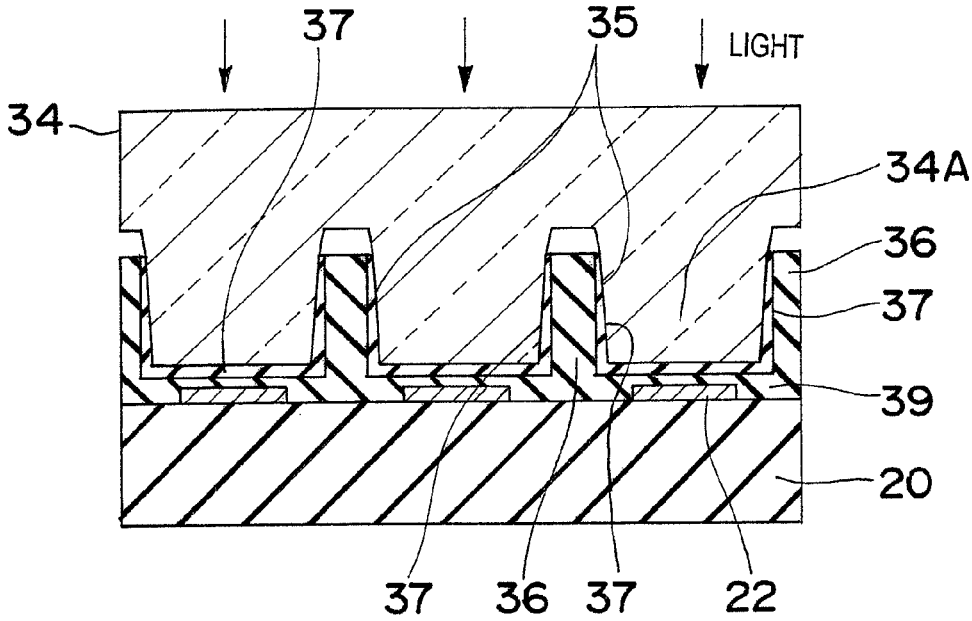
FIG. 2D is a view showing a manufacturing process of the back face panel in the PDP of the first embodiment of the present invention, which follows the process of FIG. 2C.

Following the above-mentioned forming mold copying process, FIG. 2D shows exposing processes in which prior to mold-releasing the light-transmitting forming mold 34 from the back face substrate 20, the respective layers molded by the forming mold 34 (the barrier-rib core portion 36, the base fluorescent barrier-rib portion 37, and the base undercoating dielectric layer 39) are cured and constricted so as to easily release the forming mold 34 from the back face substrate 20. The barrier-rib core portion 36, the base fluorescent barrier-rib portion 37, the base undercoating dielectric layer 39, and the base fluorescent barrier-rib portion 37 on the bottom face of the discharge cell 11, which respectively comprise the barrier-rib portion-forming layer 32 and the fluorescent barrier-rib portion-forming layer 33 by the forming mold 34, are exposed by near ultraviolet rays or visible rays that are transmitted through the forming mold 34. Since the base barrier rib 38 formed by the forming mold 34 (the barrier-rib core portion 36 and the base fluorescent barrier-rib portion 37) are comparatively thick, a strong light source and a comparative long exposing period of time are required for the curing process. Moreover, since the material that has formed the barrier-rib portion-forming layer 32 (the barrier-rib material forming one portion of the base fluorescent barrier-rib portion 37) is constricted when cured, a gap corresponding to this constricted portion is generated between the base barrier rib 38 and the male-mold convex portion 34A of the forming mold 34. In this case, the curing process through exposure has been explained; however, a drying process through a heating treatment may be used as the curing process. For example, an exposing output is set to 15 mW/cm$^2$ with an exposing period of time for 30 seconds (see Japanese Unexamined Patent Publication No. 2000-173456 and the like).

Figure 2E:
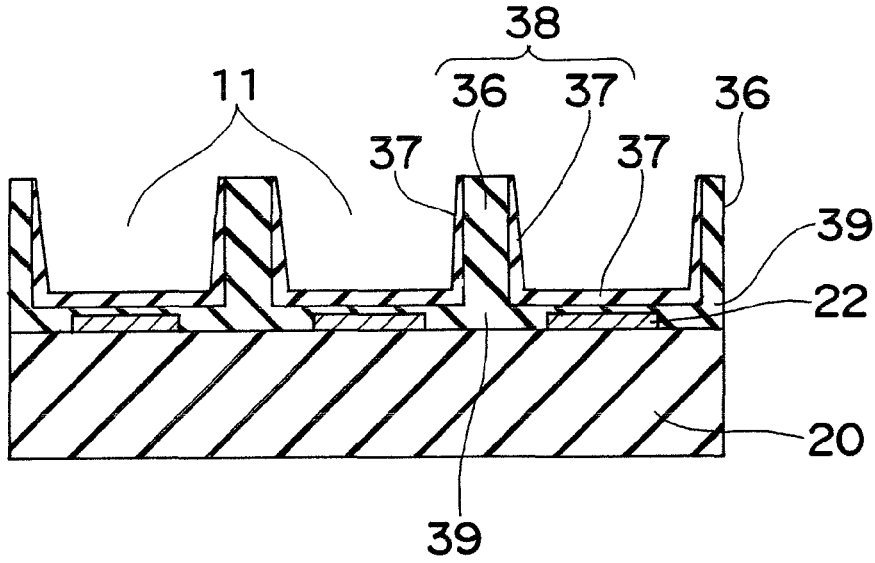
FIG. 2E is a view showing a manufacturing process of the back face panel in the PDP of the first embodiment of the present invention, which follows the process of FIG. 2D.

Next, FIG. 2E shows a cross-sectional structure of the back face panel 2 in a state where the forming mold 34 has been released from the back face substrate 20. In this state (a state after the exposing process and before a firing process), the address electrodes 22 are formed on the back face substrate 20, and the base undercoating dielectric layer 39 for the undercoating dielectric layer 21, the base barrier rib 38 (the barrier-rib core portion 36 and the base fluorescent barrier-rib portion 37), and the base fluorescent barrier-rib portion 37 on the bottom face of the discharge cell 11 are formed. Following the above-mentioned exposing process, by carrying out a firing process for firing the back face panel 2 in this state (a state after the exposing process and before a firing process) at a predetermined temperature, the base undercoating dielectric layer 39, the base barrier rib 38 (the barrier-rib core portion 36 and the base fluorescent barrier-rib portion 37), and the base fluorescent barrier-rib portion 37 on the bottom face of the discharge cell 11 are respectively fired and solidified so that, as shown in FIG. 1A, the undercoating dielectric layer 21, the barrier rib 23 (the barrier-rib portion 23A and the fluorescent barrier-rib portion 66), and the fluorescent barrier-rib portion 66 on the bottom face of the discharge cell 11 can be respectively formed. Therefore, since the barrier-rib portion 23A having only the barrier-rib material as the core exerts a function as the barrier-rib main body portion, and since the fluorescent barrier-rib portion 66, formed on the side faces of the barrier-rib portion 23A and comprising a mixed material of a phosphor material and a barrier-rib material, also contains the barrier-rib material, the fluorescent barrier-rib portion 66 is also allowed to function as a barrier-rib assistant portion. Consequently, it can also be said that the barrier rib 23 in the first embodiment has a two-layer structure of the barrier-rib portion 23A and the fluorescent barrier-rib portion 66.

Figure 2F:
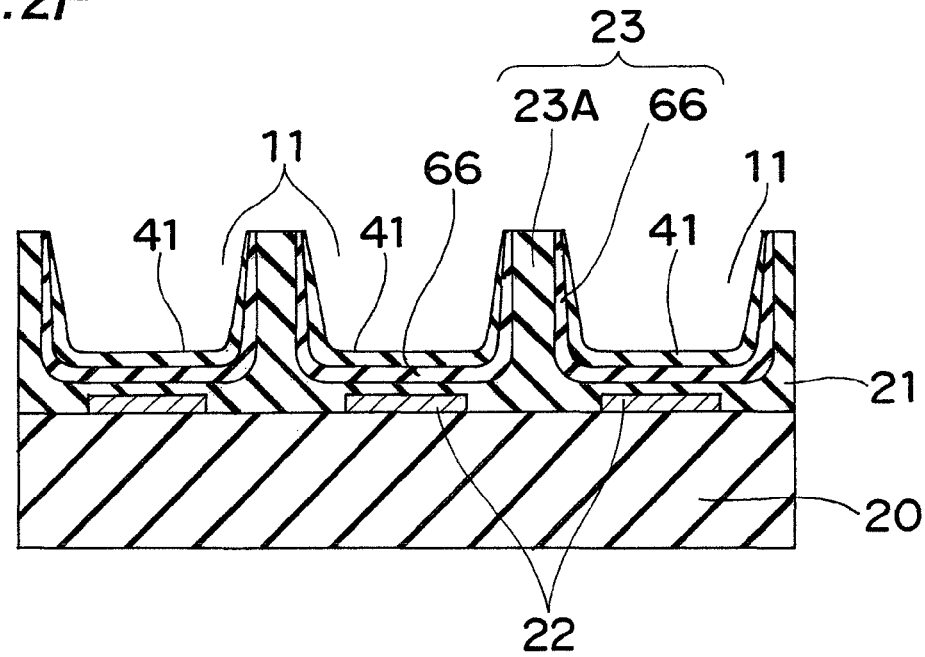
FIG. 2F is a view showing a manufacturing process of the back face panel in the PDP of the first embodiment of the present invention, which follows the process of FIG. 2E.

After this firing process, as shown in FIG. 2F, a phosphor paste is applied to the fluorescent barrier-rib portion 66 on the bottom face inside the discharge cell 11 by a dispenser method or the like so that the phosphor portion 24A comprising a phosphor material is formed as one portion of the phosphor layer 24 so that a base phosphor layer 41 is formed, and this base phosphor layer 41 is then fired so that the phosphor portion 24A is formed; thus, the back face panel 2 is completed. With respect to the base phosphor layer 41, by using phosphor pastes of red, green, and blue colors, base phosphor layers of red, green, and blue colors are prepared in association with the discharge cells 11 of red, green, and blue colors; thus, after the firing process, phosphor portions 24A of red, green, and blue colors are respectively formed.

Therefore, the phosphor portion 24A having only the phosphor material exerts a function as the phosphor layer main portion, and since the fluorescent barrier-rib portion 66, formed on the side faces of the barrier-rib portion 23A and the bottom face of the discharge cell 11, and comprising a mixed material of a phosphor material and a barrier-rib material, also contains the phosphor material, the fluorescent barrier-rib portion 66 is also allowed to function as a phosphor layer assistant portion. Consequently, it can also be said that the phosphor layer 24 in the first embodiment has a two-layer structure of the phosphor portion 24A and the fluorescent barrier-rib portion 66.

Figure 3:
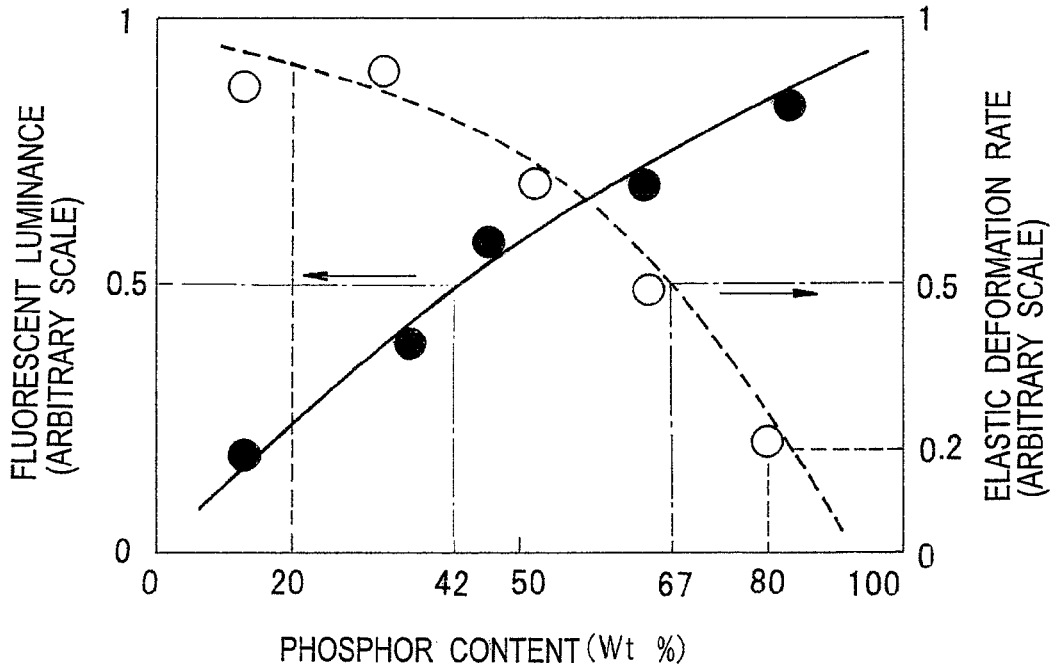
FIG. 3 is a graph showing characteristics of fluorescent luminance and elastic modulus relative to the content of a phosphor material in a fluorescent barrier-rib formation layer of the PDP in the first embodiment.

FIG. 3 is a graph showing characteristics of the fluorescent luminance and the elastic deformation rate relative to the phosphor material content in the fluorescent barrier-rib portion-forming layer 33 of the PDP according to the first embodiment. Here, the elastic deformation rate refers to the ratio of the amount of elastic deformation to the indentation depth in an indentation test. Moreover, with respect to the elastic modulus, the same tendency as that of the elastic deformation rate is seen. With respect to the fluorescent barrier-rib portion-forming layer 33, comprising a mixed material of a barrier-rib material and a phosphor material, that forms the fluorescent barrier-rib portion 66, the elastic modulus and the fluorescent luminance of the barrier rib 23 after the firing process in response to a change in the phosphor content (wt %) are shown in FIG. 3. It is found that the fluorescent luminance increases virtually in proportion to the phosphor content, while the elastic deformation rate indicating the strength of the barrier rib 23 becomes smaller as the phosphor content increases.

In the PDP produced by the manufacturing method of the first embodiment of the present invention, since the composition of the barrier-rib portion 23A corresponding to the core portion of the barrier rib 23 is a glass paste, it is confirmed that even when the elastic deformation rate of the fluorescent barrier-rib portion 66 is set to about ⅕ of that of a barrier-rib portion 23A comprising only a glass paste, the resulting PDP can be put into practical use by using prototype samples. In recent years, however, one example indicating the miniaturization of a discharge cell in response to the higher precision of a PDP shows that, for example, in comparison with a current PDP (not high precision) of 42 inches that has a cell aperture ratio of 66%, a high-precision PDP of 50 inches has a cell aperture ratio of 50%. Even in the case of PDPs of the same size, a PDP of high precision needs to have a smaller cell size and a thinner phosphor layer to cause a reduction in luminance, and the width of the barrier rib also becomes thinner to cause a reduction in strength. Here, in the case of a PDP as one example of the present embodiment in which the thickness of the barrier-rib portion is 20 μm and the thickness of the respective fluorescent barrier-rib portions on the two side faces of the barrier-rib portion is 5 μm, the total thickness of the barrier rib becomes 30 μm. In this case, since the thickness of the fluorescent barrier-rib portion is as small as 5 μm, the effective luminance is reduced to one half, with the result that in order to ensure 0.5 or more as the fluorescent luminance, from the graph of FIG. 3, the phosphor content needs to be set to 42 wt % or more. Moreover, since the thickness of the barrier rib is only 30 μm, the phosphor content needs to be set to 67 wt % or less from the graph of FIG. 3 in order to ensure at least 0.5 or more in the elastic deformation rate of the barrier rib.

Therefore, as has been explained earlier, the content of phosphor material relative to the barrier-rib material of the fluorescent barrier-rib portion 66 after the firing process is preferably set in the range of from 42 wt % to 67 wt %. Moreover, in an attempt to put preference on the fluorescent luminance rather than the strength of the barrier rib 23, the content ratio of phosphor material is preferably set in the range of from 50 wt % to 67 wt %.

Second Embodiment

Figure 4A:
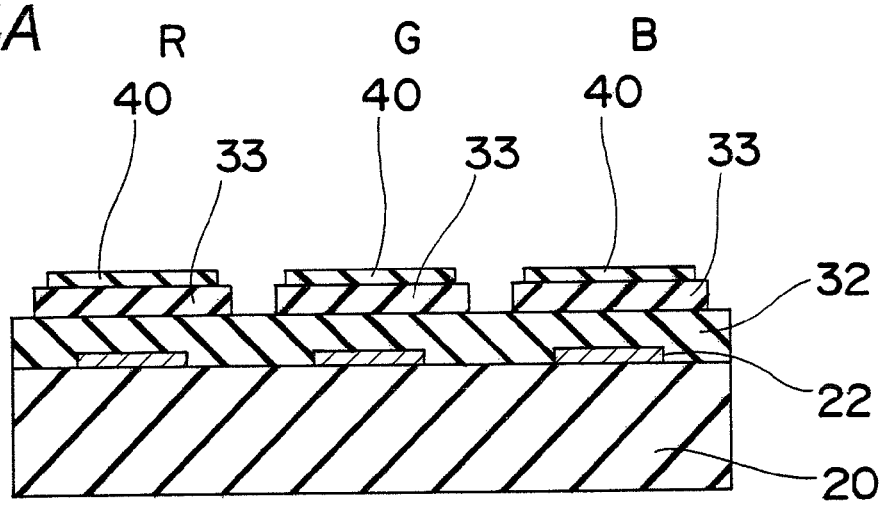
FIG. 4A is a view showing a manufacturing process of a back face panel in a PDP according to a second embodiment of the present invention.

FIGS. 4A to 4D are views showing a process of manufacturing method for a PDP according to a second embodiment of the present invention. The second embodiment of the present invention differs from the first embodiment in that as shown in FIG. 4A, after the process of FIG. 2B explained in the first embodiment, a phosphor portion-forming layer 40 used for further forming a phosphor portion 23A is patterned and formed. That is, after the barrier-rib portion-forming layer 32 has been formed on the back face substrate 20 on which the address electrodes 22 are formed, a fluorescent barrier-rib portion-forming layer 33 comprising a phosphor material and a barrier-rib material is patterned and formed so that the phosphor portion-forming layer 40, comprising only a phosphor material having the same fluorescent color as that of the fluorescent barrier-rib portion-forming layer 33, is formed on the fluorescent barrier-rib portion-forming layer 33. In the same manner as the first embodiment, the flowability of the material to form the fluorescent barrier-rib portion-forming layer 33 in response to a stress application is made smaller than the flowability of the material to form the barrier-rib portion-forming layer 32 in response to a stress application, and the flowability of a material forming the phosphor portion-forming layer 40 in response to a stress application is also made smaller than the flowability of the material to form the fluorescent barrier-rib portion-forming layer 33 in response to a stress application. That is, the material compositions are designed so that the flowability in response to a stress application becomes greater in the descending order of the barrier-rib portion-forming layer 32, the fluorescent barrier-rib portion-forming layer 33 and the phosphor portion-forming layer 40.

Figure 4B:
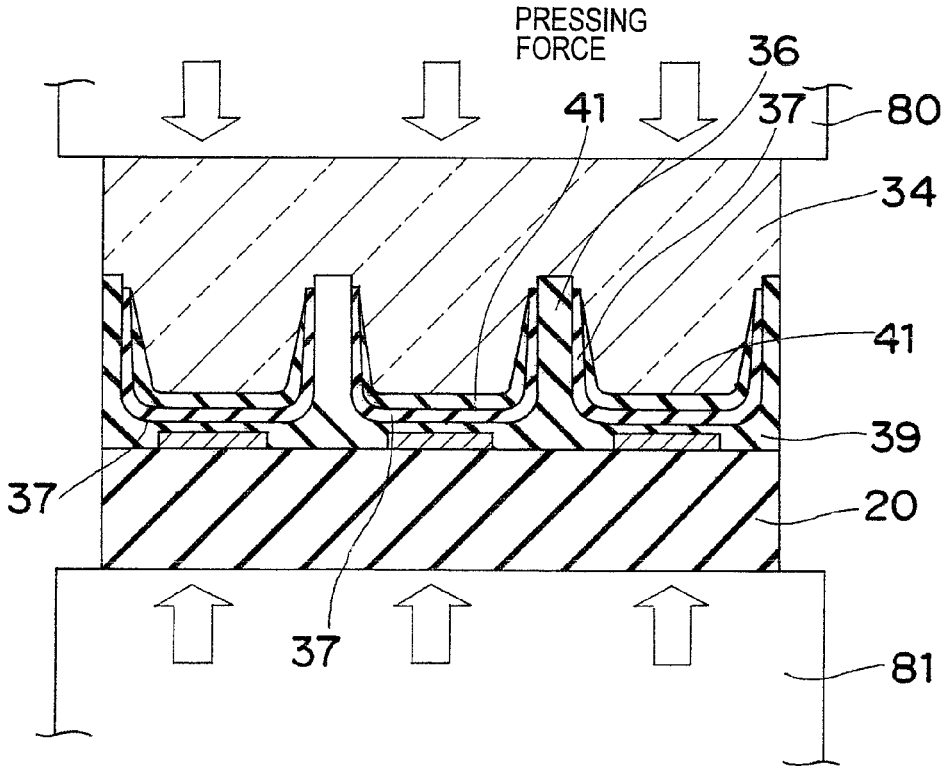
FIG. 4B is a view showing a manufacturing process of the back face panel in the PDP of the second embodiment of the present invention, which follows the process of FIG. 4A.

In the same manner as in the first embodiment, FIG. 4B shows processes in which a forming mold 34 is pressed onto the phosphor portion-forming layer 40 and pushed down in a direction indicated by an arrow so that the shape of the forming mold 34 is copied onto the phosphor portion-forming layer 40, the fluorescent barrier-rib portion-forming layer 33 and the barrier-rib portion-forming layer 32. The forming mold 34 is the same as that of the first embodiment; however, since the phosphor portion-forming layer 40 is also pressed and molded to form a base phosphor layer 41, the dimension thereof is changed correspondingly.

As shown in FIG. 4B, by pressing the forming mold 34 onto the back face substrate 20 on the base plate 81 by using a pressing member 80, the barrier-rib portion-forming layer 32, the fluorescent barrier-rib portion-forming layer 33 and the phosphor portion-forming layer 40 are plastically deformed respectively by the female-mold concave portion 35 and the male-mold convex portion 34A of the forming mold 34 so that a barrier-rib core portion 36, a base fluorescent barrier-rib portion 37, a base phosphor layer 41 and a base undercoating dielectric layer 39 are formed as layers.

Here, with respect to such a relationship between the flowability and the applied stress in which the flowability of the material to form the fluorescent barrier-rib portion-forming layer 33 in response to a stress application is made smaller than the flowability of the material to form the barrier-rib portion-forming layer 32 in response to a stress application, the same relationship as that described in the first embodiment is adopted; therefore, the explanation thereof is omitted.

In the second embodiment of the present invention, the flowability of the material to form the phosphor portion-forming layer 40 in response to a stress application is made smaller than the flowability of the material to form the fluorescent barrier-rib portion-forming layer 33 in response to a stress application. Therefore, it is possible to prevent mixed colors or the like from occurring due to a flow of the phosphor portion-forming layer 40, and also to mold the respective films with predetermined film thicknesses.

With this arrangement, in the same manner as in the first embodiment, the material to form the barrier-rib portion-forming layer 32 is allowed to flow more easily to be deformed in comparison with the material to form the fluorescent barrier-rib portion-forming layer 33 that flows along the surface of the female-mold concave portion 35 of the forming mold 34 by the pressing process of the forming mold 34 applied to the back face substrate 20. For this reason, the material to form the barrier-rib portion-forming layer 32 flows to be deformed so as to form the barrier-rib core portion 36, and intrudes into the bottom of the female-mold concave portion 35 in the female-mold concave portion 35 so that the fluorescent barrier-rib portion-forming layer 33 having a smaller flowability is molded to be positioned on the periphery of the barrier-rib core portion 36. Therefore, even by the pressing process of the forming mold 34, the fluorescent barrier-rib portion-forming layer 33 to form the base fluorescent barrier-rib portion 37 and the barrier-rib portion-forming layer 32 to form the barrier-rib core portion 36 are not mixed with each other, and it is possible to prevent a base fluorescent barrier-rib portion 37 having another color from being directed into the adjacent discharge cell over the barrier-rib core portion 36 to cause a mixed color.

Moreover, a remaining portion other than the portion that has flowed therein to form the barrier-rib core portion 36 of the material for forming the barrier-rib portion-forming layer 32 is left between the male-mold convex portion 34A of the forming mold 34 and the back face substrate 20, and this remaining portion of the material for forming the barrier-rib portion-forming layer 32 is used for forming the undercoating dielectric layer forming layer prior to a firing process, that is, a base undercoating dielectric layer 39 for use in forming a fired undercoating dielectric layer 21. At this time, a remaining portion other than the portion that has flowed therein to form the base fluorescent barrier-rib portion 37 of the material for forming the fluorescent barrier-rib portion-forming layer 33 is left on the base undercoating dielectric layer 39.

Here, the phosphor portion-forming layer 40, which has a smaller flowability than that of the fluorescent barrier-rib portion-forming layer 33, is molded between the end face of the male-mold convex portion 34A of the forming mold 34 and the base fluorescent barrier-rib portion 37 so as to stay, as it is, without moving so much; thus, a base phosphor layer 41 is formed. Consequently, even by the pressing process of the forming mold 34, the phosphor portion-forming layer 40 to form the base phosphor layer 41 and the barrier-rib portion-forming layer 32 to form the barrier-rib core portion 36 are not mixed with each other, and it is possible to prevent the base phosphor portion-forming layer 41 having another color from being directed into the adjacent discharge cell over the barrier-rib core portion 36 to cause a mixed color.

Therefore, according to the second embodiment, simultaneously as the barrier-rib core portion 36, the base fluorescent barrier-rib portion 37 and the base undercoating dielectric layer 39 are molded by the flowing of the material to form the barrier-rib portion-forming layer 32 as well as by the flowing of the material to form the fluorescent barrier-rib portion-forming layer 33, through the pressing process of the forming mold 34 to the back face substrate 20, the material to form the phosphor portion-forming layer 40 is allowed to flow so that the base phosphor portion 41 is molded; therefore, the process exclusively used for molding the base phosphor portion 41 is no longer required so that the manufacturing process can be simplified as a whole, and it becomes possible to ensure a sufficient barrier-rib strength and consequently to achieve a PDP in which the fluorescent luminance is improved.

Figure 4C:
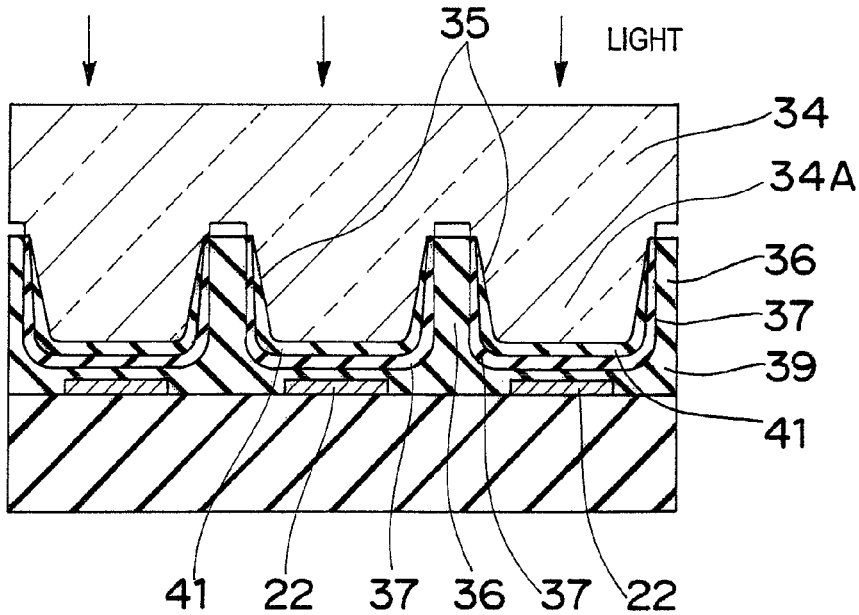
FIG. 4C is a view showing a manufacturing process of the back face panel in the PDP of the second embodiment of the present invention, which follows the process of FIG. 4B.
Figure 4D:
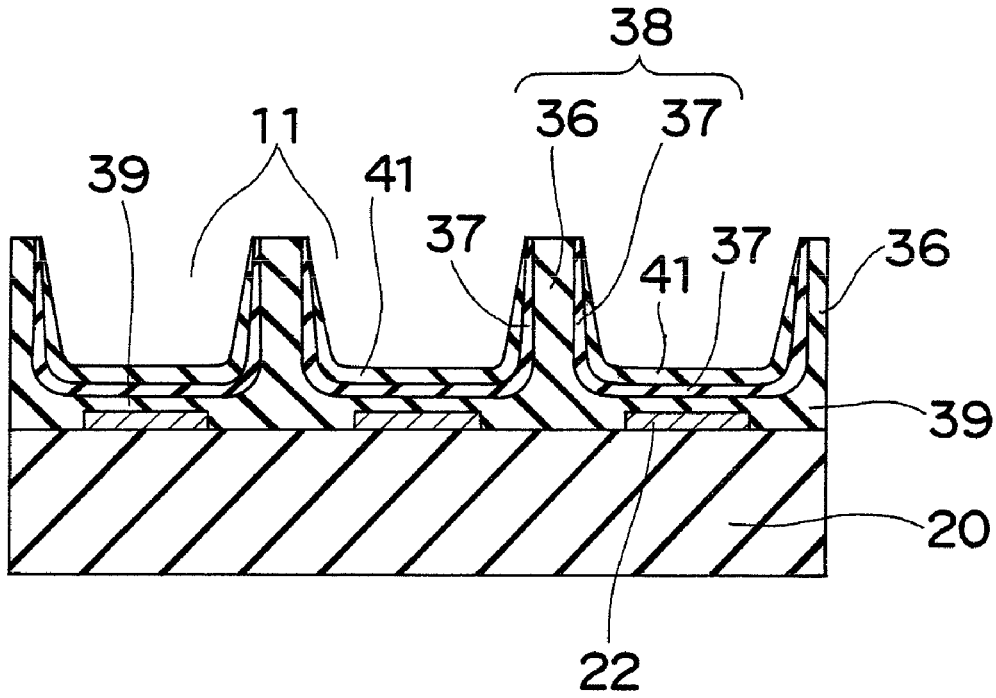
FIG. 4D is a view showing a manufacturing process of the back face panel in the PDP of the second embodiment of the present invention, which follows the process of FIG. 4C.

Here, the exposing process in FIG. 4C and the firing process in FIG. 4D are virtually the same as those exposing process shown in FIG. 2D in the first embodiment and firing process shown in FIG. 2E; therefore, the description thereof is omitted. The second embodiment differs from the first embodiment in that the phosphor portion-forming layer 40 is exposed to be cured and constricted in the same manner as in the barrier-rib portion-forming layer 32 and the fluorescent barrier-rib portion-forming layer 33, and in that the phosphor portion-forming layer 40 is fired in the same manner as in the barrier-rib portion-forming layer 32 and the fluorescent barrier-rib portion-forming layer 33.

Third Embodiment

The third embodiment and the embodiments thereafter of the present invention have been devised to solve the aforementioned issues as well as the following issues.

In order to solve the issue of a luminance reduction, for example, a method has been disclosed in which a white pigment layer having a reflective property, for example, typically comprising titanium oxide, or a reflective colored pigment layer is placed beneath the phosphor layer (for example, see Patent Document 3 (Japanese Unexamined Patent Publication No. 10-188820) and Patent Document 4 (Japanese Unexamined Patent Publication No. 8-138559)). Moreover, another method has been disclosed in which a mixed material of a barrier-rib material and a phosphor material is embedded in opening portions formed by a photosensitive film so as to form barrier ribs so that a fluorescent property is applied to the surface of the barrier rib to improve the luminance (for example, see Patent Document 1).

In the method of Patent Document 3 or Patent Document 4, however, although the luminance as the phosphor layer is improved, the layer having a reflective property (hereinafter, referred to as a reflective layer) needs to be placed beneath the phosphor layer, with the result that the virtual discharge space is narrowed to cause a reduction in the discharging efficiency and a subsequent issue of a reduction in the luminance. This issue has become more conspicuous as the recent miniaturization of the discharge cell progresses in response to the current developments of high-precision PDPs. Here, it is proposed that even when the virtual discharge space becomes smaller by the reflective layer, the discharge space is ensured by narrowing the barrier ribs correspondingly; however, when the width of the barrier rib is made too narrow, other issues arise in which defective cracked barrier ribs are caused and an erroneous discharge occurs between the adjacent cells.

In contrast, according to the method described in Patent Document 1, the effective thickness of the phosphor layer can be increased without narrowing the discharge space. However, since the respective barrier ribs having fluorescent colors of blue, green and red need to contain phosphors corresponding to the respective fluorescent colors, the pasting, exposing and developing processes of photosensitive films, the embedding process of the barrier-rib materials and the separating process of the photosensitive films have to be repeated three times, and complicated processes are consequently required, and since a large amount of resist films has to be used, the manufacturing costs become higher. Moreover, although the phosphor only needs to be exposed to the surface of the barrier rib, the phosphor material has to be contained in the entire barrier ribs to be formed. As the content of the phosphor materials increases, the adhesion of the barrier-rib material to form the barrier ribs deteriorates, making it difficult to ensure the strength of the barrier ribs to cause defective barrier ribs due to falling or the like.

In order to solve these issues in addition to the aforementioned issues with the present invention, the objective of the following embodiments is to provide a PDP in which barrier ribs that can form fine discharge cells capable of achieving both of high-precision display and high-luminance display are realized at low costs with high precision, and a manufacturing method for such barrier ribs.

Figure 5:
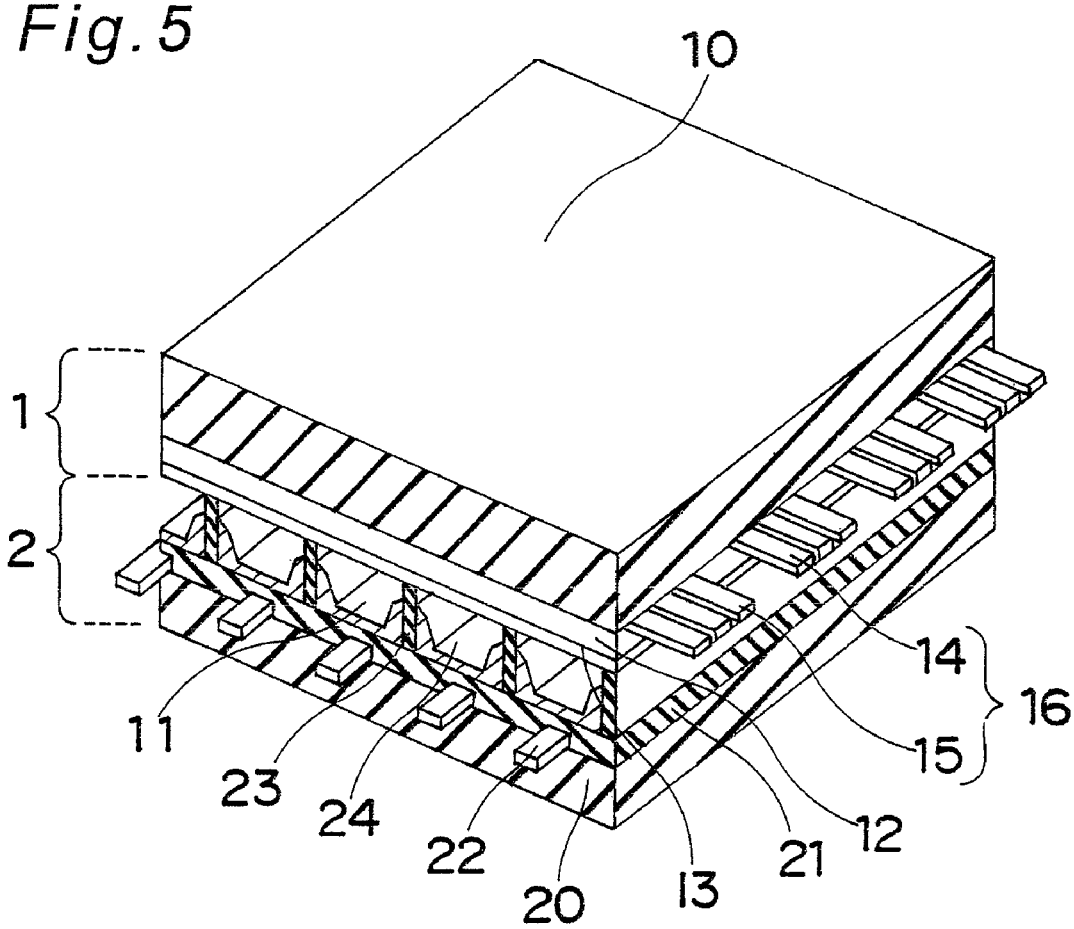
FIG. 5 is a perspective view showing an essential portion of a PDP according to a third embodiment of the present invention.

FIG. 5 is a perspective view showing essential portions of a PDP according to a third embodiment of the present invention. This PDP has a structure in which a plurality of discharge cells 11 serving as discharge spaces are formed in a matrix shape between a front face panel 1 and a back face panel 2 placed opposite to each other, and the peripheral portion of each discharge cell 11 is sealed by a sealing member (not shown) such as glass frit.

On a front face substrate 10 forming the front face panel 1, a plurality of paired display electrodes 16, constituted by scanning electrodes 14 and sustain electrodes 15 covered with a dielectric layer 12 and a protective layer 13, are arranged in parallel with one another. Each of the paired display electrodes 16 is constituted by a transparent electrode that transmits visible light and a bus electrode used for lowering the resistance of the transparent electrode.

On a back face substrate 20 forming the back face panel 2, a plurality of address electrodes 22 covered with an undercoating dielectric layer 21 are arranged in parallel with one another in a direction orthogonal to the paired display electrodes 16. Barrier ribs 23, used for separating the discharge cells 11 for each address electrode 22, are formed between the adjacent address electrodes 22. Moreover, a phosphor layer 24 is formed on the undercoating dielectric layer 21 as well as on the side faces of each barrier rib 23.

Here, although not shown in FIG. 5, in a manner similar to FIG. 1B, the barrier rib 23 is configured by a barrier-rib portion 23B formed only by a barrier-rib material and a portion made by the barrier-rib material of a fluorescent assistant layer (fluorescent barrier-rib portion) 70, which is formed on the side faces of the barrier-rib portion 23B by using a mixed material of the barrier-rib material and a phosphor material.

In a manner similar to FIG. 1B, the phosphor layer 24 is constituted by the portion of the phosphor material of the fluorescent assistant layer (fluorescent barrier-rib portion) 70 and a phosphor portion 24B formed only by the phosphor material in a manner so as to cover the florescent assistant layer (fluorescent barrier-rib portion) 70.

Here, the barrier-rib portion 23B, the fluorescent assistant layer (fluorescent barrier-rib portion) 70 and the phosphor portion 24B form three structural portions with respective clear borders, but the border lines are not necessarily formed linearly, and have arbitrary shapes such as a straight line, a curved line and a zig-zag line; however, for convenience of easy understanding of the third embodiment, these are simplified, and linearly illustrated in FIG. 5 (see FIG. 1B) and the like. That is, the fluorescent assistant layer (fluorescent barrier-rib portion) 70 is formed on the barrier-rib portion 23B intentionally in a manner so as to cover the barrier-rib portion 23B, and there is a clear border between the fluorescent assistant layer (fluorescent barrier-rib portion) 70 and the barrier-rib portion 23B. Moreover, there is a clear border between the fluorescent assistant layer (fluorescent barrier-rib portion) 70 and the phosphor portion 24B as well. After completion of the back face panel 2, the barrier-rib material is fused, but since the phosphor material remains as powder, as it is, the respective borders can be recognized when the cross section is observed. It can also be said that, in the barrier rib 23, the barrier-rib portion 23B functions as the barrier-rib main body portion, while the above-mentioned fluorescent assistant layer (fluorescent barrier-rib portion) 70 functions as a barrier-rib assistant portion. Moreover, it can also be said that, in the phosphor layer 24, the phosphor portion 24B functions as the phosphor-layer main body portion, while the fluorescent assistant layer (fluorescent barrier-rib portion) 70 serves as a phosphor-layer assistant portion. Consequently, the above-mentioned fluorescent assistant layer (fluorescent barrier-rib portion) 70 has both of functions, that is, the function as the barrier-rib assistant portion and the function as the phosphor-layer assistant portion.

For example, a gas, such as a neon gas and a xenon gas, is sealed in the discharge cell 11 as a gas that discharges ultraviolet rays through discharging. The phosphor layer 24 (that is, the phosphor material in the fluorescent assistant layer (fluorescent barrier-rib portion) 70 and the phosphor material in the phosphor portion 24B) is excited by the ultraviolet rays generated by the discharge inside the discharge cell 11 so that visible light is generated to display an image. As described above, the PDP has the structure in which the discharge cells 11, arranged in a matrix shape, form an image display area, with the various electrodes being formed on the surface opposing to the front face substrate 10 and the surface opposing to the back face substrate 20, and by applying various driving voltages to these electrodes from external driving circuits, an image is displayed.

Next, a method for manufacturing the back face panel 2 will be described in detail.

FIGS. 6A to 6H are views showing manufacturing processes of the back face panel 2 of a PDP according to the third embodiment of the present invention.

In FIGS. 6A to 6H, a forming mold 131 is constituted by a concave portion 130 and a convex portion 138, and the concave portion 130 is provided with concave portion side faces 136*a*, 136*b* that are tilted into tapered shapes that approach each other toward the bottom face side and a concave portion bottom face 137. The concave portion 130 has a shape corresponding to an inverted shape of the barrier rib 23, that is, a reversed trapezoidal shape. The two concave portion side faces 136*a* and 136*b* that face each other to form the concave portion 130 correspond to side face portions of the barrier rib 23 of adjacent discharge cells on a finished back face panel. The shape of the concave portion 130 is designed so that the barrier-rib 23, formed by transferring a material filled in the concave portion 130 onto the back face substrate 20 and baking the material, has a trapezoidal shape in its cross section with 120 μm in height, 35 μm in upper bottom area, 50 μm in lower bottom area and 220 μm in pitch. However, the present invention is not intended to be limited by these designed values, and the shape of the barrier ribs 23 may be formed into a lattice shape, a stripe shape, or the like. With respect to the base member of the forming mold 131, not particularly limited, a material, such as plastics, metal, ceramics and glass, may be used.

In the third embodiment of the present invention, a paste-state fluorescent assistant material composition 132 and a fluorescent assistant material are used. The fluorescent assistant material composition 132 to be used here refers to a paste-state composition that contains a barrier-rib material and a fluorescent assistant material as inorganic main components to which a solvent, an organic additive and the like are added. The barrier-rib material forming the barrier ribs 23 comprises a metal oxide or the like, such as boron oxide, silicon oxide, bismuth oxide, lead oxide and titanium oxide, and formed into the barrier ribs 23 when fused by firing. Moreover, the fluorescent assistant material refers to at least one material selected from a phosphor material and a reflective material. Moreover, with respect to a material for assisting fluorescence of the blue phosphor layer (hereinafter, referred to as a blue fluorescent assistant material), a blue phosphor material, or a white or blue reflective material is selected. With respect to a material for assisting fluorescence of the green phosphor layer (hereinafter, referred to as a green fluorescent assistant material), a green phosphor material, or a white or green reflective material is selected. With respect to a material for assisting fluorescence of the red phosphor layer (hereinafter, referred to as a red fluorescent assistant material), a red phosphor material, or a white or red reflective material is selected. The fluorescent assistant material is allowed to assist fluorescence from the phosphor portion 24B when it is exposed to the surface of the discharge cell 11.

Next, specific examples of the fluorescent assistant material are shown below: Examples of the blue fluorescent assistant material include a phosphor material, such as ZnS:Ag, $BaMgAl_{10}O_{17}$:Eu, $BaMgAl_{14}O_{23}$:Eu, or $BaMgAl_{16}O_{26}$:Eu; or a reflective material, such as titanium oxide, aluminum oxide, or a Co—Al—Cr-based pigment. Examples of the green fluorescent assistant material include a phosphor material, such as ZnS:Cu, $Zn_2SiO_4$:Mn, $Y_2O_2S$:Tb, or $YBO_3$:Tb; or a reflective material, such as titanium oxide, aluminum oxide, or a Ti—Zn—Co—Ni-based pigment. Examples of the red fluorescent assistant material include a phosphor material, such as $Y_2O_3$:Eu, $Zn_3(PiO_4)_2$:Mn, $YVO_4$:Eu, or (Y, Gd)$BO_3$:Eu; or a reflective material, such as titanium oxide or an iron-oxide-based pigment.

With respect to the ratio between the fluorescent assistant material and the barrier-rib material, as the content of the fluorescent assistant material becomes higher, the improvement of the fluorescent luminance in the discharge cell 11 is expected; however, since the adhesion to the barrier-rib portion 23B is lowered, issues, such as coming-off and lighting-failure, tend to occur. Therefore, by adjusting the mixed ratio of the barrier-rib material and the fluorescent assistant material to 42 wt % to 67 wt %, a barrier rib 23B, which has a comparatively higher fluorescent luminance even in a miniaturized discharge cell 11, and exerts a sufficient strength that can withstand practical use, is achieved. That is, when the content of the fluorescent assistant material is less than 42 wt %, the improvement of the fluorescent luminance in the discharge cell 11 is not expected, while in the case when the content of the fluorescent assistant material is 42 wt % or more, the improvement of the fluorescent luminance in the discharge cell 11 is expected. In contrast, in the case of the fluorescent assistant material exceeding 67 wt %, the adhesion to the surface of the barrier-rib portion 23B is undesirably lowered, while in the case when the fluorescent assistant material is set to 67 wt % or less, the adhesion to the surface of the barrier-rib portion 23B (in other words, strength) is sufficiently improved so as to withstand practical use.

Moreover, the barrier-rib material composition refers to a paste-state composition that is composed of a barrier-rib material, a solvent, an organic additive and the like, and used for forming the barrier-rib portion 23B.

Next, respective steps used for manufacturing the back face panel 2 will be described with reference to FIGS. 6A to 6H.

Figure 6A:
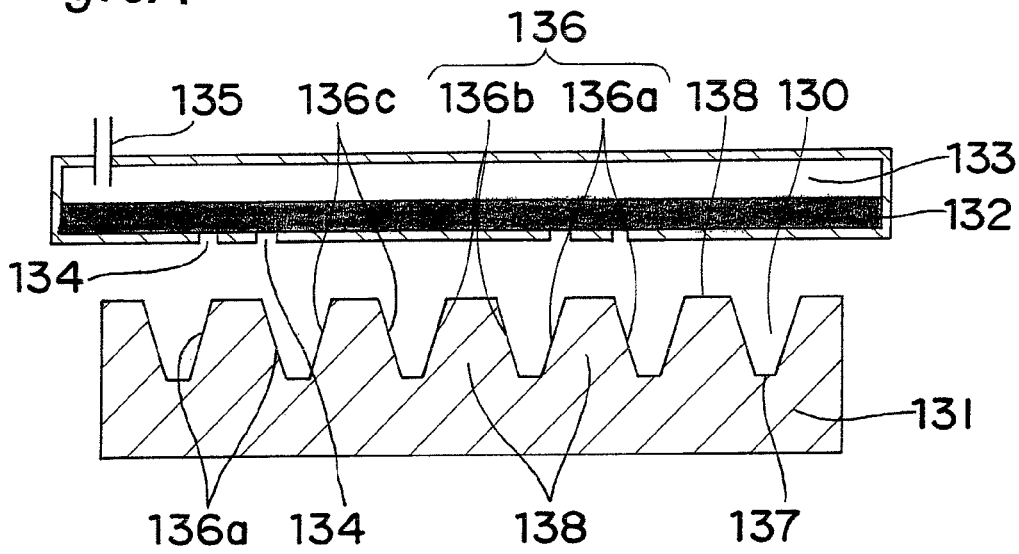
FIG. 6A is a view showing a manufacturing process of a back face panel in the PDP according to the third embodiment of the present invention.

As shown in FIG. 6A, a paste-state blue fluorescent assistant material composition 132 is loaded into a dispenser tank 133. A plurality of aperture portions 134 corresponding to coating sites of a forming mold 131 of the back face panel 2 are formed on the lower portion of the dispenser tank 133.

Here, the forming mold 131 of the back face panel 2 is provided with a convex portion 138 and a concave portion 130 formed therein, which respectively correspond to respective discharge cells 11 and respective barrier-rib portions 23B of the back face panel 2 with reversed shapes in the concave and convex portions.

The dispenser tank 133 is provided with respective aperture portions 134 on its bottom face, which are formed at positions that are allowed to face the two side faces (for example, two side faces 136*a*) of each convex portion 138, and by supplying air into the dispenser tank 133 from an air supply port 135, the paste-state fluorescent assistant material composition 132, housed in the dispenser tank 133, is discharged from the respective aperture portions 134 into the concave portion side faces 136*a* of each convex portion 138 to be applied thereon. In this third embodiment, first, the following description will discuss operations in which only the dispenser tank 133 for blue color is prepared, and by using the dispenser tank 133 housing a blue-color fluorescent assistant material composition 132, the blue-color fluorescent assistant material composition 132 is applied to the concave portion side faces 136*a* for blue color of each convex portion 138 in the forming mold 131.

Figure 6B:
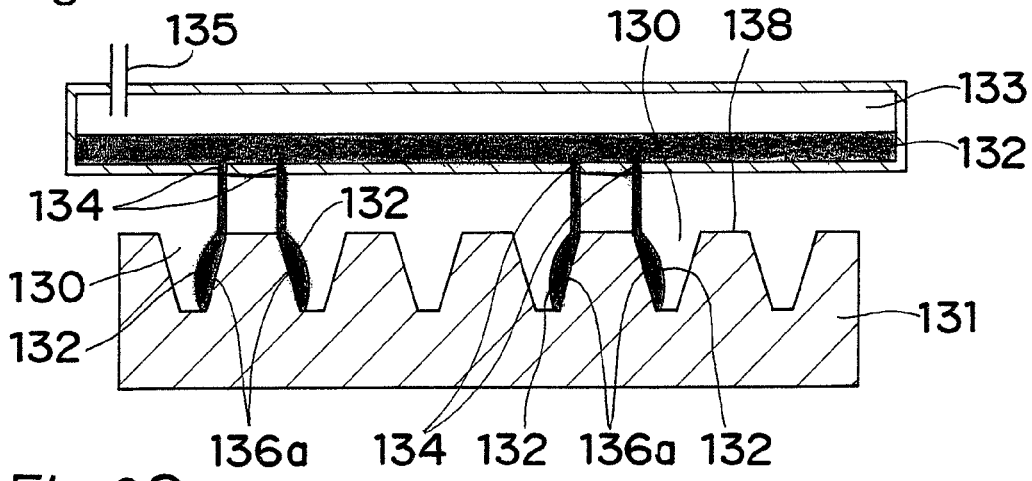
FIG. 6B is a view showing a manufacturing process of the back face panel in the PDP of the third embodiment of the present invention, which follows the process of FIG. 6A.

Next, FIG. 6B shows a step in which the blue-color fluorescent assistant material composition 132 is simultaneously applied to a plurality of pairs of concave portion side faces 136*a* for blue color of the forming mold 131, so as to form the portion of the barrier-rib material of the fluorescent assistant layer (fluorescent barrier-rib portion) 70 as one portion of each barrier rib 23 and also to form the portion of the fluorescent assistant material of the fluorescent assistant layer (fluorescent barrier-rib portion) 70 as one portion of the phosphor layer 24. After a positioning process has been carried out so that the coating sites corresponding to the respective concave portion side faces 136*a* of the forming mold 131 are made coincident with the respective aperture portions 134 of the dispenser tank 133, air is supplied into the dispenser tank 133 through the air supply port 135, while the dispenser tank 133 is being relatively shifted by using a shifting device such as an XY stage along the grooves of each concave portion 130 of the forming mold 131, so that the blue-color fluorescent assistant material composition 132 is discharged through the respective aperture portions 134. Thus, the application of the blue-color fluorescent assistant material composition 132 is simultaneously carried out onto the respective concave portion side faces 136*a* of the forming mold 131. With respect to the side faces 136*a* to be coated, not particularly limited as long as they are faces corresponding to the concave portion slanted side faces in the discharge cell 11 on which the blue phosphor is to be formed, and as shown in FIG. 6A, the two concave portion side faces 136*a* may be coated at one time, or only one of the concave portion side faces 136*a* may be coated. Moreover, if necessary, (as shown in FIG. 6B), each convex portion 138 sandwiched by the two concave portion side faces 136*a* may be coated simultaneously, or in a separated manner. Although the above explanation has exemplified a dispenser as its coating method, a screen printing method or the like may be applied.

Figure 6C:
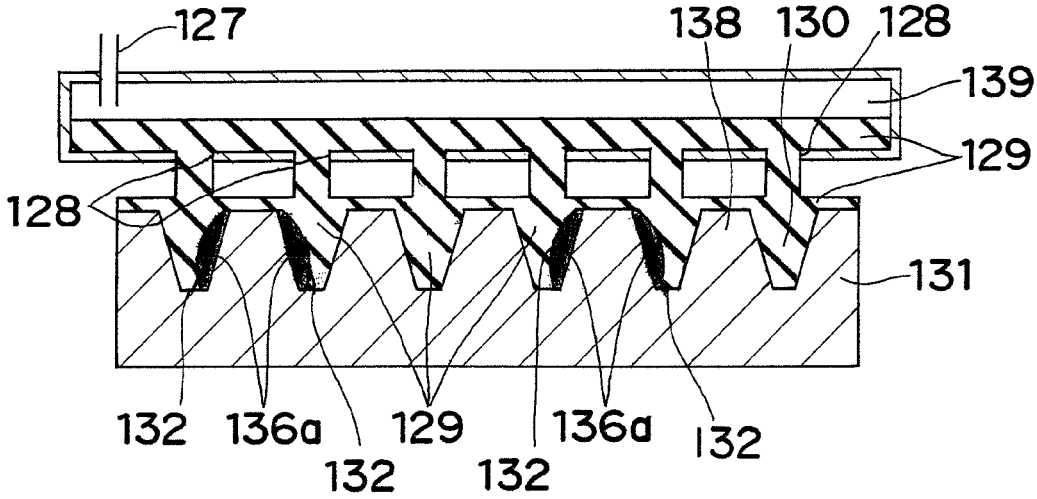
FIG. 6C is a view showing a manufacturing process of the back face panel in the PDP of the third embodiment of the present invention, which follows the process of FIG. 6B.

Following the step for applying the blue-color fluorescent assistant material composition 132, FIG. 6C shows a step in which the paste-state barrier-rib material composition 129 is injected into a center portion void of each concave portion 130 with one of the concave portion side faces 136*a* being coated with the blue-color fluorescent assistant material composition 132 of the concave portions 130 in the forming mold 131 and the void of another concave portion 130 so that a barrier-rib portion 23B comprising the barrier-rib material composition 129 is formed as one portion of each barrier rib 23. The paste-state barrier-rib material composition 129 is loaded into a dispenser tank 139 for barrier ribs, and by supplying air into the dispenser tank 139 for barrier ribs from an air supply port 127, the paste-state barrier-rib material composition 129 housed inside the dispenser tank 139 for barrier ribs is discharged from the respective aperture portions 128 by an air pressure so that all the concave portions 130 are simultaneously filled with the paste-state barrier-rib material composition 129. Here, in this process, in addition to the filling process of the barrier-rib material composition 129 into the concave portions 130, a coating process of the barrier-rib material composition 129 onto the surface of each convex portion 138 may also be carried out.

With respect to the injection-coating method, different from the process in FIG. 6B, since it is not necessary to specify portions to be coated, in addition to methods, such as a dispenser method, a nozzle method and a pattern printing method, a method for coating the entire portions, such as a solid printing method and a die-coating method, may be selected. Moreover, if necessary, by carrying out a deforming treatment of bubbles generated between the concave portions 130 and the barrier-rib material composition 129 due to the injection, it is possible to prevent defects such as cracks in the barrier-rib portion 23B due to the mixed bubbles. Furthermore, if necessary, the inorganic solvent in the barrier-rib material composition 129 is dried.

Figure 6D:
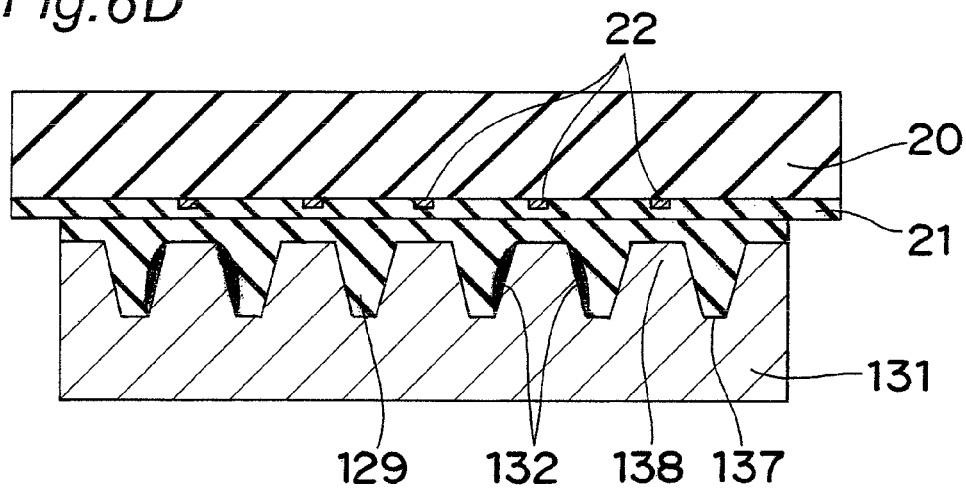
FIG. 6D is a view showing a manufacturing process of the back face panel in the PDP of the third embodiment of the present invention, which follows the process of FIG. 6C.

Next, following the step of injecting the barrier-rib material composition 129, FIG. 6D shows a step in which the back face substrate 20 and the barrier-rib material composition 129 of the forming mold 131 are made in contact with each other. The forming mold 131, filled with the blue-color fluorescent assistant material composition 132 and the barrier-rib material composition 129, is mounted on the surface of the back face substrate 20, and both of the back face substrate 20 and the forming mold 131 are pressed, if necessary, so that the back face substrate 20 and the barrier-rib material composition 129 of the forming mold 131 are bonded to each other.

At this time, with respect to the back face substrate 20, address electrodes 22 are formed on a plain glass plate, and the undercoating dielectric layer 21 is formed in a manner so as to cover the address electrodes 22, and the surface of the undercoating dielectric layer 21 is made in contact with the forming mold 131. Prior to the contact thereof, a positioning process is carried out between the back face substrate 20 and the forming mold 131. That is, the back face substrate 20 and the forming mold 131 are positioned so that the center of each address electrode 22 on the back face substrate 20 is located in the center of each convex portion 138 of the forming mold 131. By carrying out this process, either the barrier-rib material composition 129 or the fluorescent assistant material composition 132, applied or injected to the forming mold 131, is made in contact with the back face substrate 20.

Figure 6E:
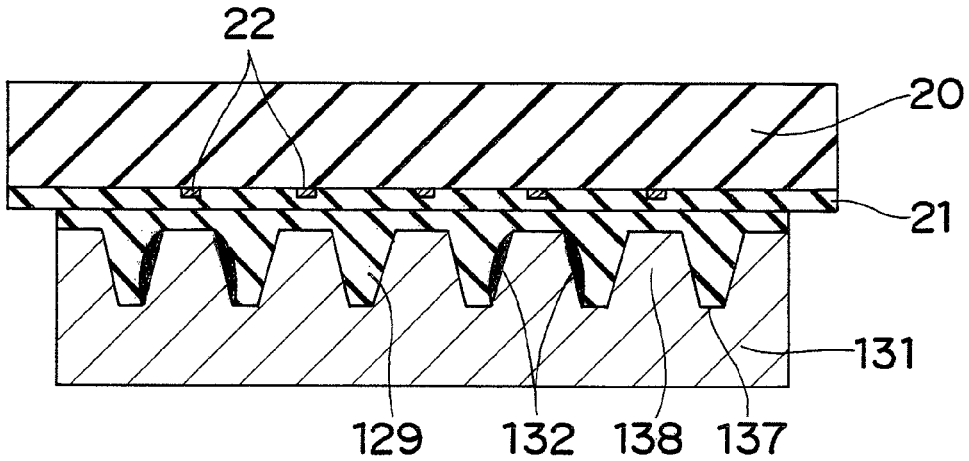
FIG. 6E is a view showing a manufacturing process of the back face panel in the PDP of the third embodiment of the present invention, which follows the process of FIG. 6D.

Next, following the step of making the back face substrate 20 and the forming mold 131 in contact with each other, FIG. 6E shows a step of curing the fluorescent assistant material composition 132 and the barrier-rib material composition 129. The back face substrate 20 and the forming mold 131, made in contact with each other, is heated and cured by a heating furnace or the like. The heating and curing processes are preferably carried out while the back face substrate 20 and the forming mold 131 are being pressed, in order to ensure adhesion among the fluorescent assistant material composition 132, the barrier-rib material composition 129 and the back face substrate 20. By carrying out this process, the fluorescent assistant material composition 132 and the barrier-rib material composition 129 are constricted in the curing process so that the barrier-rib material composition 129 and fluorescent assistant material composition 132 adhered to the back face substrate 20 are easily separated from the forming mold 131.

Figure 6F:
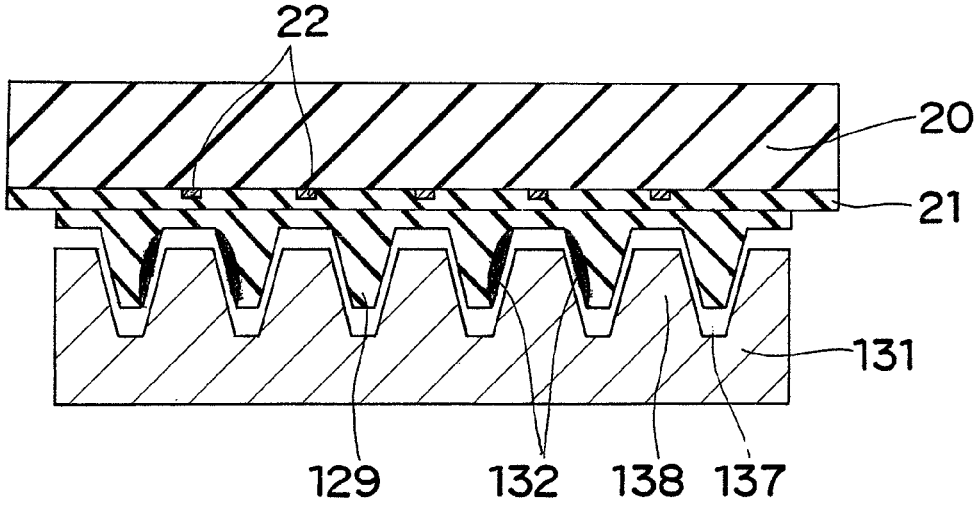
FIG. 6F is a view showing a manufacturing process of the back face panel in the PDP of the third embodiment of the present invention, which follows the process of FIG. 6E.

Next, following the step of curing the fluorescent assistant material composition 132 and the barrier-rib material composition 129, FIG. 6F shows a step in which the fluorescent assistant material composition 132 and the barrier-rib material composition 129 are mold-released from the forming mold 131. After completion of the curing processes of the fluorescent assistant material composition 132 and the barrier-rib material composition 129, the forming mold 131 is released from the back face substrate 20, as well as from the barrier-rib material composition 129 and the fluorescent assistant material composition 132 adhered to the back face substrate 20.

Figure 6G:
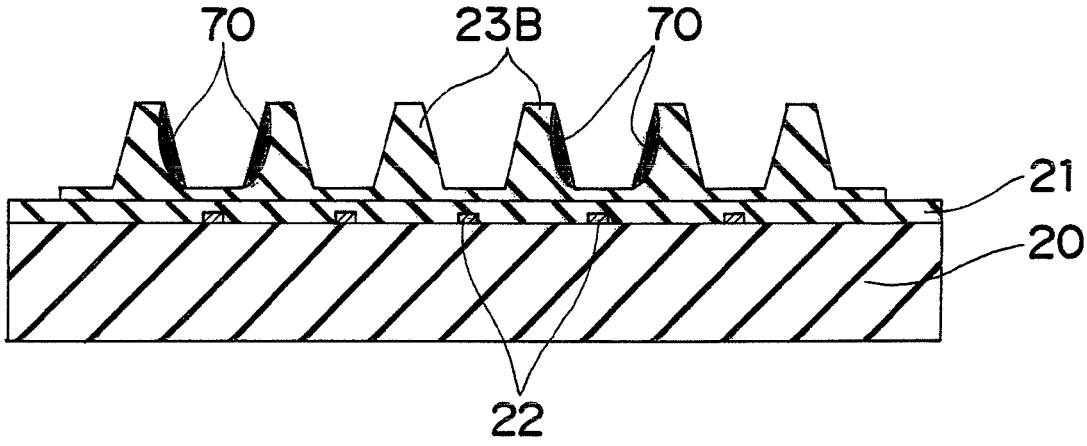
FIG. 6G is a view showing a manufacturing process of the back face panel in the PDP of the third embodiment of the present invention, which follows the process of FIG. 6F.

Next, following the step of mold-releasing the fluorescent assistant material composition 132 and the barrier-rib material composition 129 from the forming mold 131, FIG. 6G shows a step of firing the fluorescent assistant material composition 132 and the barrier-rib material composition 129 released from the forming mold 131. The back face substrate 20 including the barrier-rib material composition 129 and the fluorescent assistant material composition 132 is fired by a firing furnace or the like so that the paste-state compositions, such as the solvent or the organic additive, in the fluorescent assistant material composition 132 and the barrier-rib material composition 129 are fired and eliminated, and the fluorescent assistant material composition 132 and the barrier-rib material composition 129 are respectively solidified; thus, the fluorescent assistant layer (fluorescent barrier-rib portion) 70 and the barrier-rib portion 23B are respectively formed on the back face substrate 20. By carrying out this step, the fluorescent assistant material composition 132 is formed into the blue-color fluorescent assistant layer (fluorescent barrier-rib portion) 70 that functions as one portion of the phosphor layer 24 and as one portion of the barrier rib 23, while the barrier-rib material composition 129 is formed into the barrier-rib portion 23B that functions as one portion of the barrier rib 23. This blue-color fluorescent assistant layer 70 corresponds to the fluorescent barrier-rib portion 66 in the first and second embodiments, and functions as another fluorescent barrier-rib portion 70 different from the fluorescent barrier-rib portion 66. Here, the fluorescent barrier-rib portion 70 of the third embodiment differs from the fluorescent barrier-rib portion 66 of the first and second embodiments in that it may contain a reflective material in place of the phosphor material (in other words, in that it is composed of a phosphor material and a barrier-rib material or a reflective material and a barrier-rib material). Therefore, more specifically, it can be said that the fluorescent assistant layer (fluorescent barrier-rib portion) 70 corresponds to the fluorescent assistant barrier-rib portion.

Figure 6H:
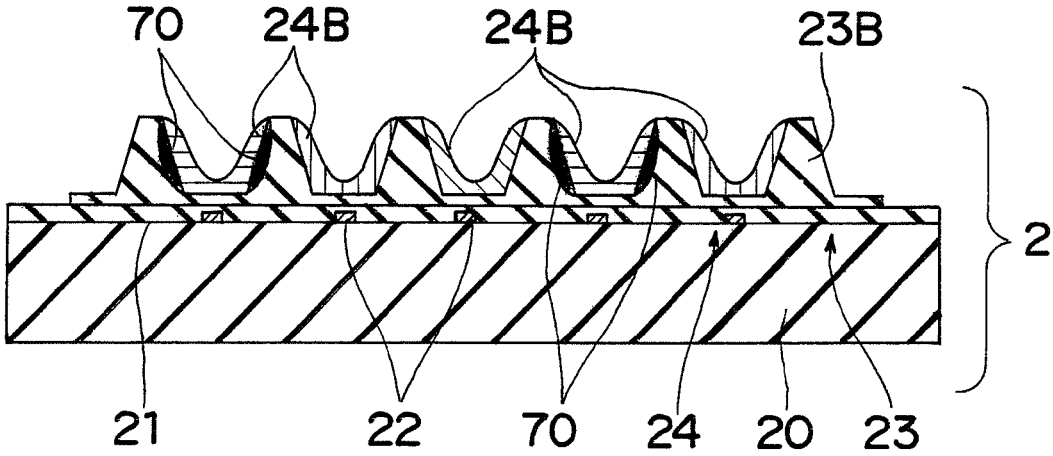
FIG. 6H is a view showing a manufacturing process of the back face panel in the PDP of the third embodiment of the present invention, which follows the process of FIG. 6G.

Next, following the step of firing the fluorescent assistant material composition 132 and the barrier-rib material composition 129, FIG. 6H shows a finished back face panel 2 which has been formed through processes in which a paste-state blue phosphor material is inserted into the discharge cells corresponding to the barrier-rib portions 23B, with the blue-color fluorescent assistant layer 70 being formed on the wall faces thereof, so as to form the phosphor portion 24B comprising the phosphor material as one portion of the phosphor layer 24, and paste-state green and red phosphor materials are respectively inserted into the other discharge cells 11 so as to form the phosphor portion 24B. The phosphor portion 24B functions as one portion of the phosphor layer 24.

In a PDP manufactured by using the back face panel 2 in this manner, since the blue-color fluorescent assistant layer 70 is allowed to emit light by ultraviolet rays generated when the blue-color discharge cells are turned on, the light-emission intensity of the blue-color phosphor portion 24B is compensated for by the light emission of the blue-color fluorescent assistant layer 70 so that the light-emission intensity can be improved. Alternatively, since blue-color visible light generated upon turning on of the blue-color discharge cells 11 is reflected by the blue-color fluorescent assistant layer 70, the light-emission intensity of the blue-color phosphor portion 24B is compensated for by the reflection of the blue-color fluorescent assistant layer 70 so that the light-emission intensity can be improved.

Note that the above-mentioned description has exemplified a structure in which the blue-color fluorescent assistant layer 70 is formed on the surface of each barrier-rib portion 23B having one kind of color; however, a discharge cell of another color may be incorporated into the barrier-rib portion 23B. In this case, after a coating process of the fluorescent assistant layer 70 having one kind of color, or after the drying process thereof, fluorescent assistant material compositions having different colors can be applied to a pair of concave portion side faces 136*b* and a pair of concave portion side faces 136*c* (see FIG. 6A) that are adjacent thereto and made face to face therewith.

Moreover, upon application of the fluorescent assistant material composition to the convex portion 138, the fluorescence assisting property can be applied not only to the side face portions of the barrier-rib portion 23B, but also to the bottom portion of the discharge cell 11. Moreover, the content of the fluorescent assistant material to be applied to the concave portion side faces 136*a*, 136*b* and the convex portion 138 may be changed. That is, a fluorescent assistant material containing the reflective material more may be applied to the concave portion side faces 136*a* and 136*b*, while a fluorescent assistant material containing the phosphor material more may be applied to the convex portion 138.

Moreover, prior to the process of FIG. 6B, an oil repellent material such as zirconia is applied to the concave bottom face 137 so as to provide oil repellency to the bottom face so that during the process of applying the fluorescent assistant material composition, it is possible to prevent the fluorescent assistant material composition adhered to the concave portion side faces 136*a* and 136*b* from being further applied to the concave portion bottom face 137. Thus, it becomes possible to prevent the fluorescent assistant material composition from being directed to the top portion of a finished barrier-rib portion 23B or the adjacent discharge cell 11 to cause a mixed color.

Moreover, by applying a lipophilic material such as a long chain aliphatic acid to the concave portion side faces 136*a* and 136*b* to impart a lipophilic property thereto, the affinity of the fluorescent assistant material composition for the concave side faces 136*a* and 136*b* is improved so that the coating process of the fluorescent assistant material composition can be carried out quickly.

Fourth Embodiment

Figure 7A:
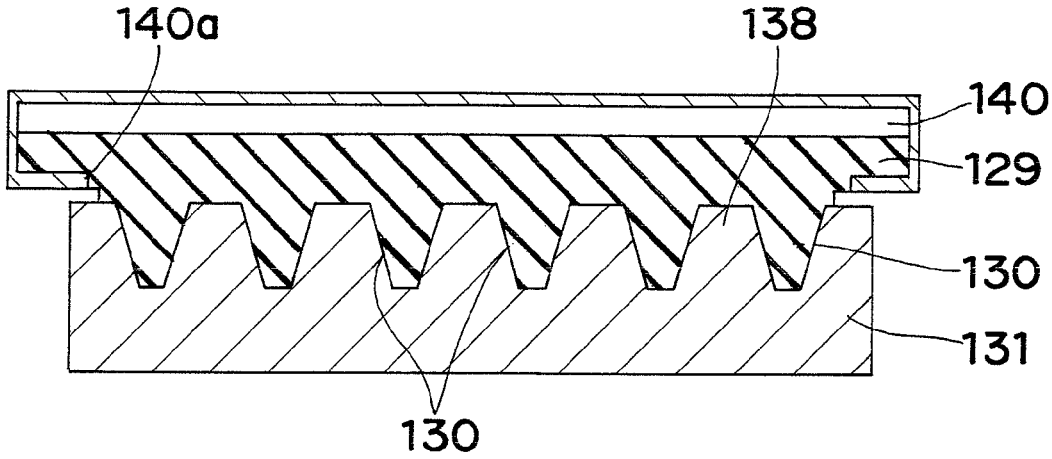
FIG. 7A is a view showing a manufacturing process of a back face panel in a PDP according to a fourth embodiment of the present invention.

FIGS. 7A to 6G are views showing manufacturing processes of a back face panel 2 of a PDP according to the fourth embodiment of the present invention. The fourth embodiment of the present invention differs from the third embodiment only in that prior to the application of the fluorescent assistant material composition 132 in FIG. 6B as explained in the third embodiment, as shown in 7A and 7B, a core member 71 of a barrier-rib portion 23C corresponding to the barrier-rib portion 23B is formed in a concave portion 130 in a forming mold 131 and injected thereto. That is, the barrier-rib portion 23C of the back panel 2 of the PDP in the fourth embodiment has a double structure in which the core member 71 is placed in the center portion with a barrier-rib material composition 129 being fired on the side faces thereof to form a barrier-rib assistant portion 72. Therefore, in the fourth embodiment, a barrier rib 23 is constituted by the barrier-rib portion 23C made of the core member 71 and the barrier-rib assistant portion 72, and also formed only by the barrier-rib material, and the portion of the barrier-rib material of a fluorescent assistant layer (fluorescent barrier-rib portion) 70 formed on the side faces of the barrier-rib portion 23C by using a mixed material of the barrier-rib material and the phosphor material. Moreover, similar to FIG. 1B, a phosphor layer 24 is constituted by the portion of the phosphor material of the fluorescent assistant layer (fluorescent barrier-rib portion) 70 and the phosphor portion 24C formed only by the phosphor material in a manner so as to cover the fluorescent assistant layer (fluorescent barrier-rib portion) 70.

Here, the barrier-rib portion 23C, the fluorescent assistant layer (fluorescent barrier-rib portion) 70 and the phosphor portion 24C form three structural portions with respective clear borders; however, the border lines are not necessarily formed linearly, and have arbitrary shapes such as a straight line, a curved line and a zig-zag line; however, for convenience of easy understanding of the fourth embodiment, these are simplified and illustrated linearly. That is, the fluorescent assistant layer (fluorescent barrier-rib portion) 70 is formed on the barrier-rib portion 23C intentionally in a manner so as to cover the barrier-rib portion 23C, and there is a clear border between the fluorescent assistant layer (fluorescent barrier-rib portion) 70 and the barrier-rib portion 23C. Moreover, there is a clear border between the fluorescent assistant layer (fluorescent barrier-rib portion) 70 and the phosphor portion 24C as well. After completion of the panel, the barrier-rib material is fused, but since the phosphor material remains as powder, as it is, the respective borders can be recognized when the cross section is observed. It can also be said that, in the barrier rib 23, the barrier-rib portion 23C functions as the barrier-rib main body portion, while the above-mentioned fluorescent assistant layer (fluorescent barrier-rib portion) 70 functions as a barrier-rib assistant portion. Moreover, it can also be said that, in the phosphor layer 24, the phosphor portion 24C functions as the phosphor-layer main body portion, while the fluorescent assistant layer (fluorescent barrier-rib portion) 70 functions as a phosphor-layer assistant portion. Consequently, the above-mentioned fluorescent assistant layer (fluorescent barrier-rib portion) 70 has both of functions, that is, the function as the barrier-rib assistant portion and the function as the phosphor-layer assistant portion.

FIG. 7A shows a step of injecting the barrier-rib material composition 129 into the concave portion 130 of the forming mold 131. The barrier-rib material composition 129 is loaded into a die coater 140, and the barrier-rib material composition 129 is simultaneously injected into all the concave portions 130 from aperture portions 140*a* of the die coater 140. The coating method is not particularly limited by the die coating method, and is preferably selected from methods, such as a solid printing method, a dispenser method, a nozzle method and a pattern printing method. Moreover, the barrier-rid material composition 129 adhering to the convex portion 138 of the forming mold 131 is removed therefrom by using a squeegee or the like, if necessary.

Figure 7B:
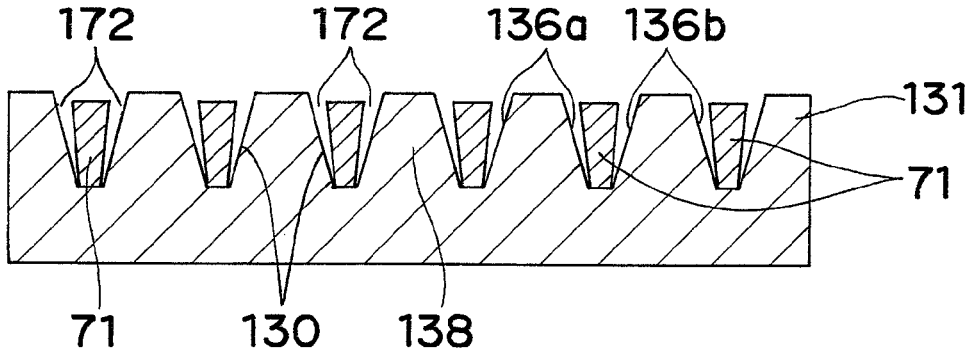
FIG. 7B is a view showing a manufacturing process of the back face panel in the PDP of the fourth embodiment of the present invention, which follows the process of FIG. 7A.

Next, following the injecting step of the barrier-rib material composition 129, FIG. 7B shows a gap-forming step in which fluorescent assistant material layer forming gaps 172 are formed between the barrier-rib material composition 129 injected into the concave portions 130 and the concave portion side faces 136*a*, 136*b*. The gaps 172 are formed, for example, by curing the barrier-rib material composition 129 injected into the concave portion 130 by heating or a method such as light irradiation. Thus, the barrier-rib material composition 129 is constricted, and the core member 71 is formed with the gaps 172 being placed between the constricted barrier-rib material composition 129 and the concave portion side faces 136*a*, 136*b*.

Figure 7C:
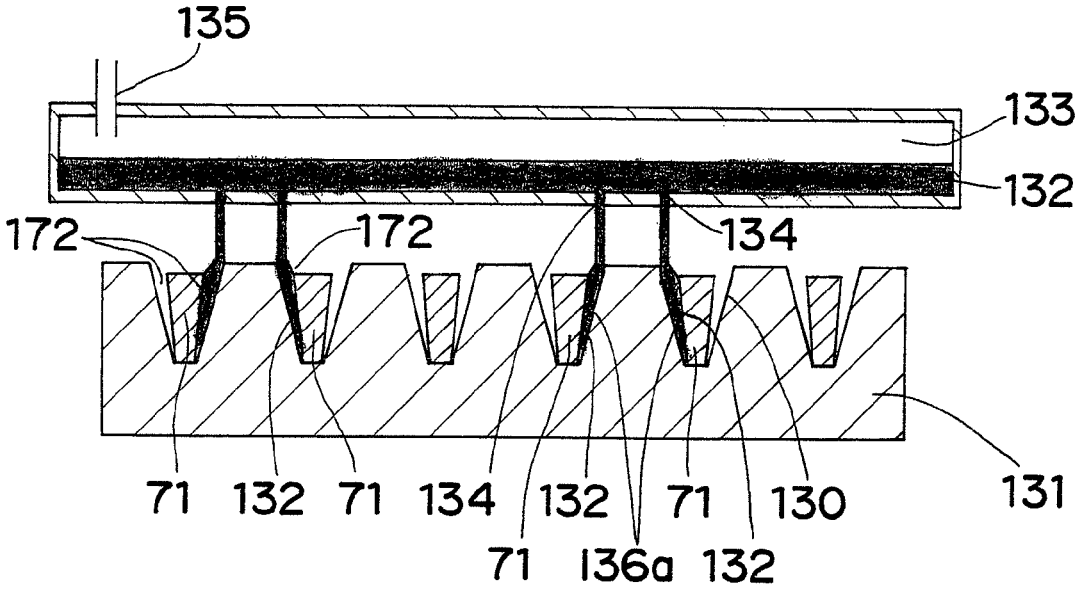
FIG. 7C is a view showing a manufacturing process of the back face panel in the PDP of the fourth embodiment of the present invention, which follows the process of FIG. 7B.

Next, following the gap-forming step, FIG. 7C shows a step in which a paste-state blue-color fluorescent assistant material composition 132 is simultaneously applied to the gaps 172 formed between a plurality of concave portion side faces 136*a* for blue color of the forming mold 131 and the core members 71. In the same manner as shown in FIG. 6B in the third embodiment, after a positioning process has been carried out so that the coating sites corresponding to the respective concave portion side faces 136*a* of the forming mold 131 are made coincident with the respective aperture portions 134 of a dispenser tank 133, air is supplied from an air supply port into the dispenser tank 133, while the dispenser tank 133 is being relatively shifted by using a shifting device such as an XY stage along the grooves of each concave portion 130 of the forming mold 131, so that the blue-color fluorescent assistant material composition 132 is discharged through the respective aperture portions 134. Thus, the application of the blue-color fluorescent assistant material composition 132 is simultaneously carried out onto the respective concave portion side faces 136*a* of the forming mold 131.

Figure 7D:
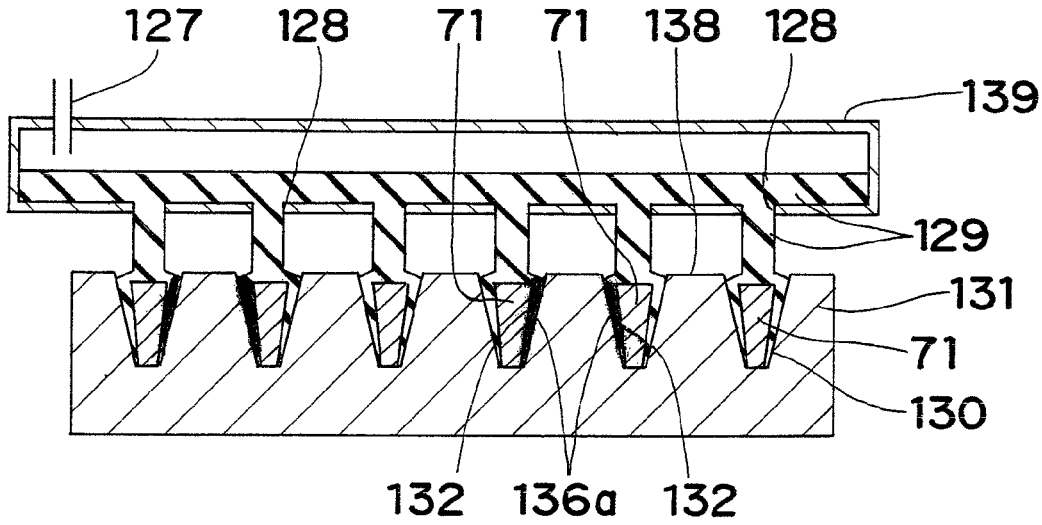
FIG. 7D is a view showing a manufacturing process of the back face panel in the PDP of the fourth embodiment of the present invention, which follows the process of FIG. 7C.

Next, following the step of applying the blue-color fluorescent assistant material composition 132, as shown in FIG. 7D, a paste-state barrier-rib material composition 129 is injected into the gap 172 corresponding to a left space of the concave portion 130 after having been filled with the blue-color fluorescent assistant material composition 132. That is, in the same manner as shown in FIG. 6C of the third embodiment, the paste-state barrier-rib material composition 129 is loaded into a dispenser tank 139 for the barrier ribs, and by supplying air into the dispenser tank 139 from an air supply port 127, the paste-state barrier-rib material composition 129, housed in the dispenser tank 139 for the barrier ribs, is discharged through the respective aperture portions 128 by an air pressure so that the barrier-rib material composition 129 is simultaneously injected into all the concave portions 130.

Figure 7E:
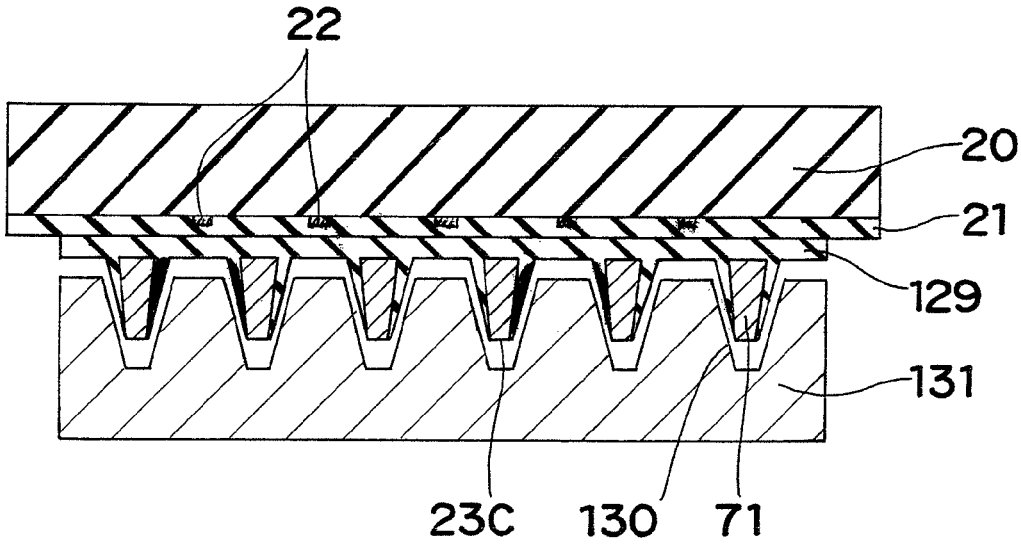
FIG. 7E is a view showing a manufacturing process of the back face panel in the PDP of the fourth embodiment of the present invention, which follows the process of FIG. 7D.

Thereafter, following the step of injecting the barrier-rib material composition 129, the step of making the back face substrate 20 and the barrier-rib material composition 129 of the forming mold 131 in contact with each other so that the back face substrate 20 and the barrier-rib material composition 129 of the forming mold 131 are bonded to each other (in the same manner as in FIG. 6D, not shown in the Figures), the step of curing the fluorescent assistant material composition 132 and the barrier-rib material composition 129 (in the same manner as in FIG. 6E, not shown in the Figures), the step of mold-releasing the fluorescent assistant material composition 132 and the barrier-rib material composition 129 from the forming mold 131 (in the same manner as in FIG. 6F, shown in FIG. 7E.), the step of firing the fluorescent assistant material composition 132 and the barrier-rib material composition 129 (in the same manner as in FIG. 6G, shown in FIG. 7F), and the step of injecting the paste-state blue-color phosphor material into discharge cells 11 corresponding to the barrier-rib portions 23C, with the blue-color fluorescent assistant layer 70 being formed on the wall faces thereof, while paste-state green-color and red-color phosphor materials are respectively injected into the other discharge cells 11 so that the phosphor portions 24C are respectively formed (in the same manner as in FIG. 6H, shown in FIG. 7G), are carried out so that the back face panel 2 is obtained. After the step of making the back face substrate 20 and the forming mold 131 in contact with each other, the same steps as those steps of FIGS. 6D to 6H in the third embodiment are carried out; therefore, the description thereof will be omitted.

Figure 7F:
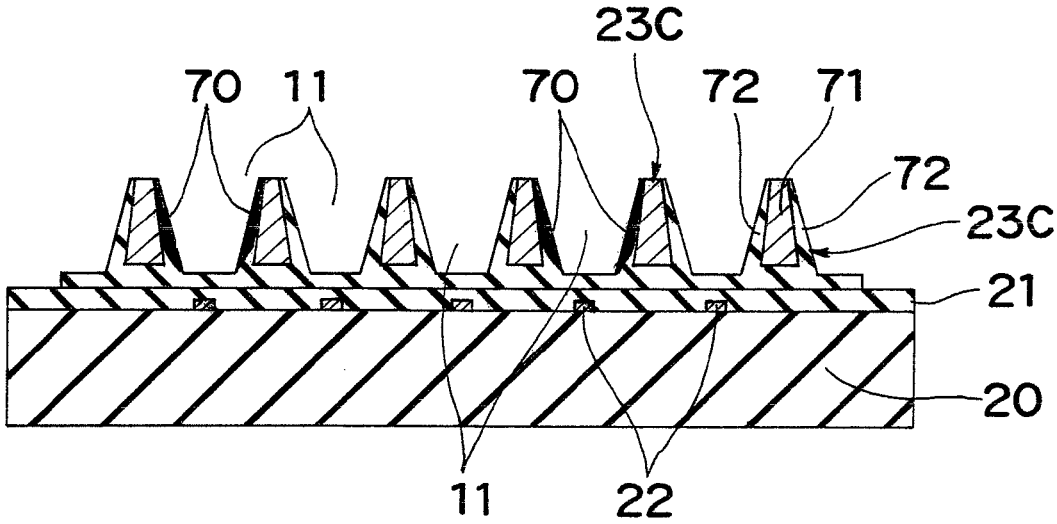
FIG. 7F is a view showing a manufacturing process of the back face panel in the PDP of the fourth embodiment of the present invention, which follows the process of FIG. 7E.
Figure 7G:
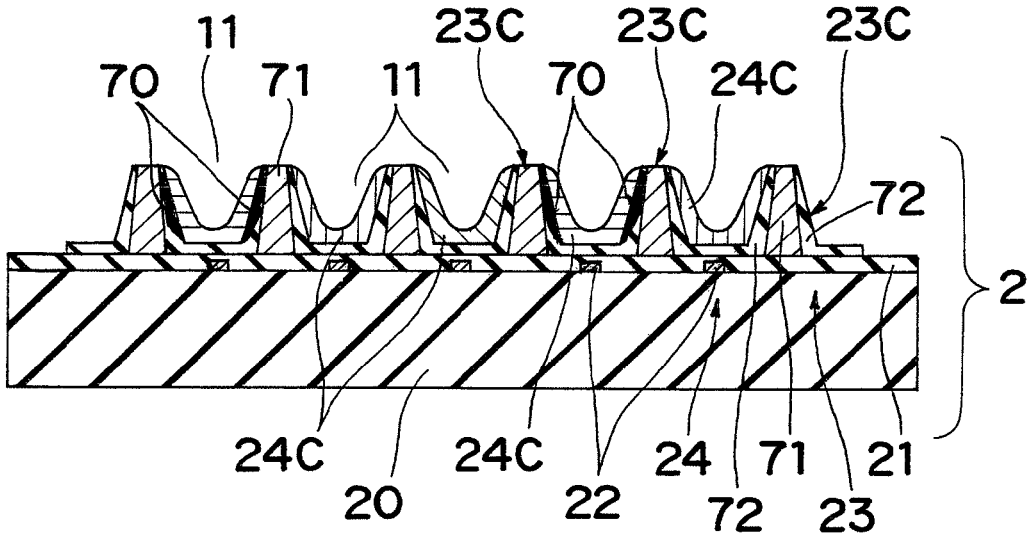
FIG. 7G is a view showing a manufacturing process of the back face panel in the PDP of the fourth embodiment of the present invention, which follows the process of FIG. 7F.

In this manner, as shown in FIG. 7F, the back face panel having the blue-color fluorescent assistant layer 70 formed on the lower portion of the blue-color phosphor layer of the phosphor portion 24C can be achieved.

The back face panel 2 thus formed makes it possible to achieve a PDP having basically the same effects as those shown in the third embodiment; however, by using the core member 71 preliminarily formed on the concave portion 130, the fluorescent assistant material composition 132 can be more positively injected and applied only to the side faces of a predetermined concave portion 130.

Here, the above-mentioned description has exemplified a structure in which only the blue-color fluorescent assistant material composition 132 is injected and applied thereto as the fluorescent assistant material composition 132; however, even in the case when a red-color or green-color fluorescent assistant material composition 132 is injected and applied to the side faces of the concave portion 130 having the corresponding color, it becomes possible to achieve the back face panel 2 that is free from mixed colors of these.

Fifth Embodiment

Figure 8A:
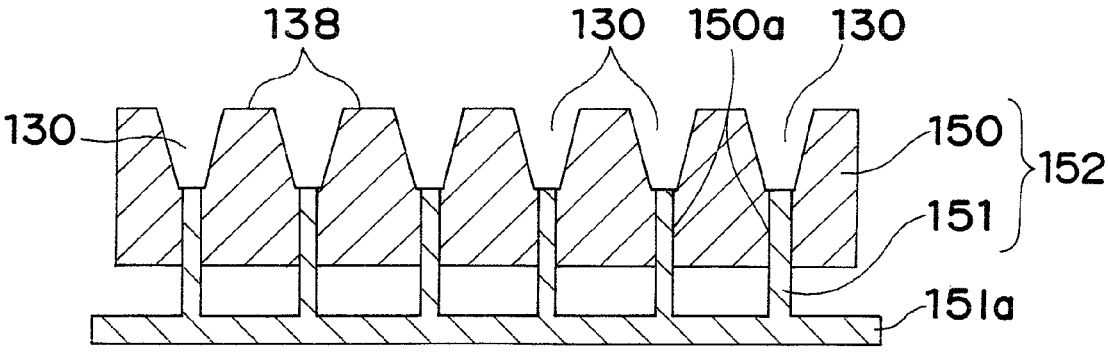
FIG. 8A is a view showing a manufacturing process of a back face panel in a PDP according to a fifth embodiment of the present invention.

FIGS. 8A to 8I are views showing manufacturing processes of a back face panel 2 of a PDP according to a fifth embodiment of the present invention. The fifth embodiment of the present invention differs from the third embodiment only in that in place of the forming mold 131 explained in the third embodiment, a composite forming mold 152 is used. As shown in FIG. 8A, the composite forming mold 152 is constituted by a first forming mold 150 used for molding barrier-rib side faces and a second forming mold 151 having an end portion 153 used for molding a barrier-rib bottom portion, which are combined with each other.

Moreover, as shown in FIG. 8A, a thin plate-shaped second forming mold 151, with its lower end portion being integrally secured to a coupling member 151*a*, is fitted and inserted into a through groove 150*a* of the first forming mold 150 so that the end portion 153 of the second forming mold 151 is allowed to form a bottom face of a concave portion 130 having a shape corresponding to the inverted shape of the barrier rib. Furthermore, as shown in FIG. 8B, by raising the coupling member 151*a* of the second forming mold 151 so as to approach the first forming mold 150, the end portion 153 of the second forming mold 151 is located in an upper level than the position of the bottom face of the concave portion 130 inside the concave portion 130 of the first forming mold 150 so that the position of the barrier-rib bottom face can be molded with higher precision.

Figure 8B:
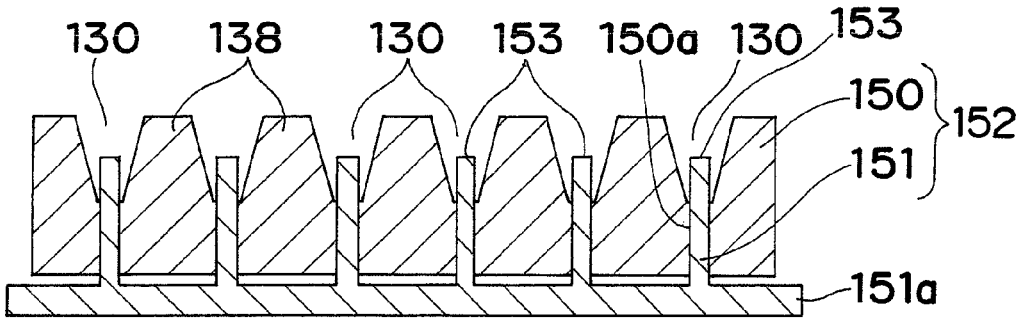
FIG. 8B is a view showing a manufacturing process of the back face panel in the PDP of the fifth embodiment of the present invention, which follows the process of FIG. 8A.
Figure 8C:
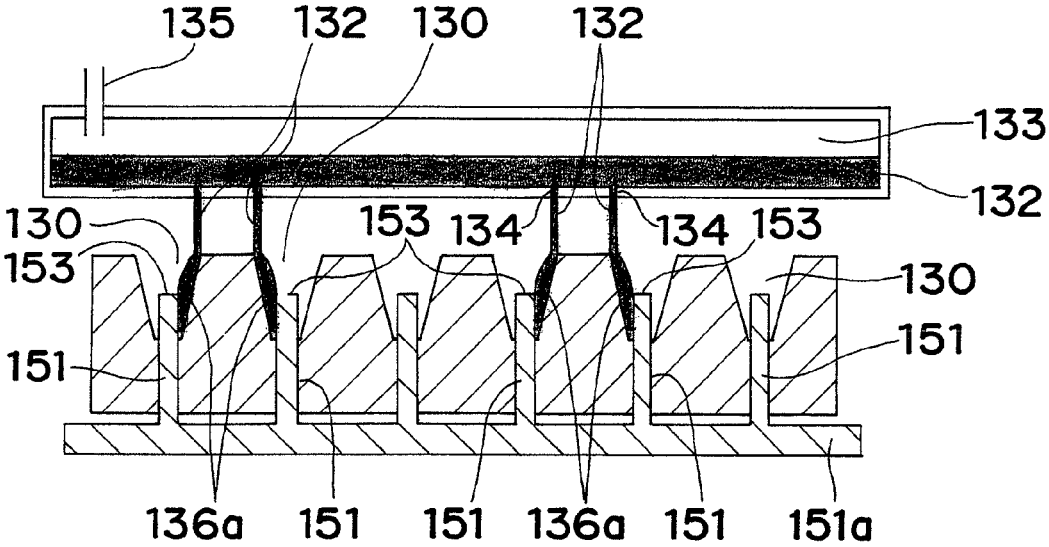
FIG. 8C is a view showing a manufacturing process of the back face panel in the PDP of the fifth embodiment of the present invention, which follows the process of FIG. 8B.

Next, following the step of position-adjusting the end portion 153 of the second forming mold 151, FIG. 8C shows a step in which a blue-color fluorescent assistant material composition 132 is simultaneously applied to a plurality of concave portion side faces 136*a* for blue color of the composite forming mold 152 in a state as shown in FIG. 8B. After a positioning process has been carried out so that the coating sites corresponding to the respective concave portion side faces 136*a* of the first forming mold 151 are made coincident with the respective aperture portions 134 of a dispenser tank 133, air is supplied into the dispenser tank 133 from an air supply port 135, while the dispenser tank 133 is being relatively shifted by using a shifting device such as an XY stage along the grooves of each concave portion 130 of the first forming mold 150, so that the blue-color fluorescent assistant material composition 132 is discharged through the respective aperture portions 134. Thus, the application of the blue-color fluorescent assistant material composition 132 is simultaneously carried out onto the respective concave portion side faces 136*a* of the forming mold 150. With respect to the coating method, the same method as that explained in FIG. 6B of the fifth embodiment is carried out; therefore, the detailed explanation thereof will be omitted.

Figure 8D:
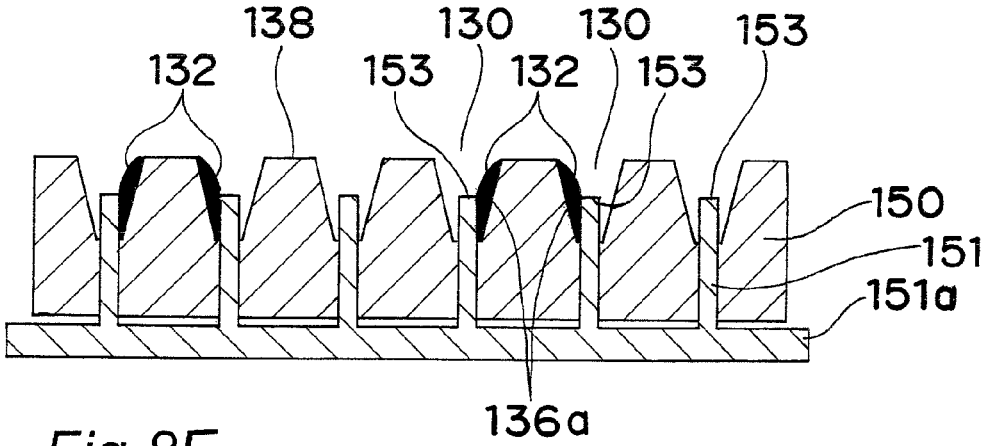
FIG. 8D is a view showing a manufacturing process of the back face panel in the PDP of the fifth embodiment of the present invention, which follows the process of FIG. 8C.

FIG. 8D shows a state in which the blue-color phosphor assistant material composition 132 has been applied onto the side faces 136*a*.

Figure 8E:
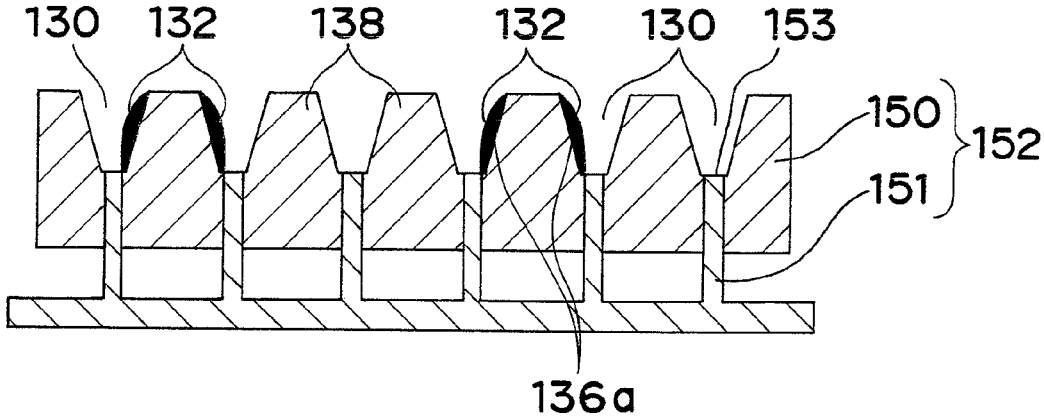
FIG. 8E is a view showing a manufacturing process of the back face panel in the PDP of the fifth embodiment of the present invention, which follows the process of FIG. 8D.

Next, following the step of applying the blue-color fluorescent assistant material composition 132, as shown in FIG. 8E, the coupling member 151*a* of the second forming mold 151 is lowered to be separated from the first forming mold 150 so as to allow the end portion 153 of the second forming mold 151 of the composite forming mold 152 to form the bottom face of the concave portion 130, that is, to form a state as shown in FIG. 8A, so that the end portion 153 of the second forming mold 151 is pulled down.

Figure 8F:
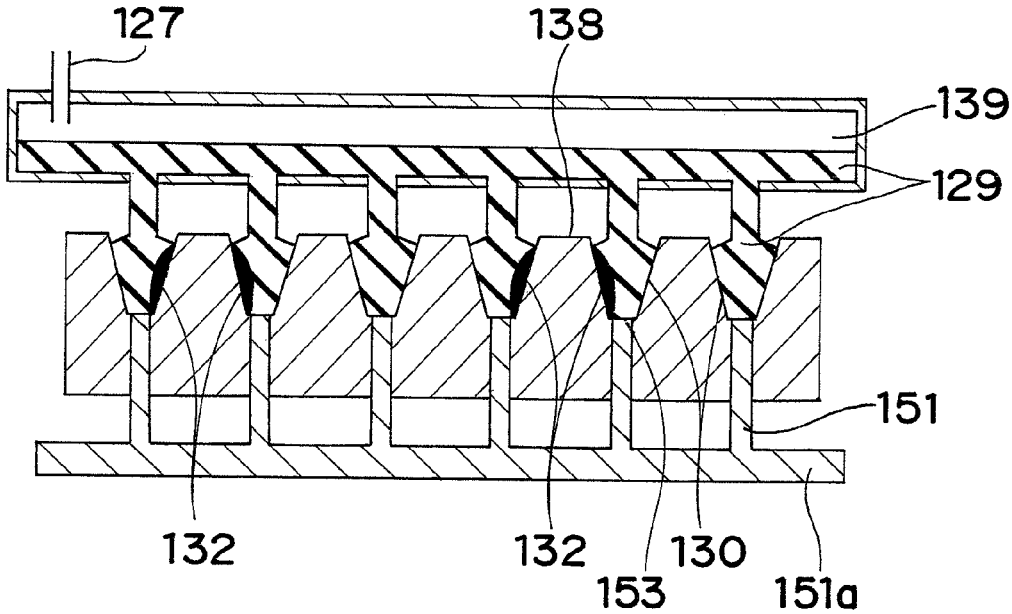
FIG. 8F is a view showing a manufacturing process of the back face panel in the PDP of the fifth embodiment of the present invention, which follows the process of FIG. 8E.

Next, FIG. 8F shows a step in which, after the end portion 153 of the second forming mold 151 has been lowered, a paste-state barrier-rib material composition 129 is injected into a center portion void of each concave portion 130 with one of the concave portion side faces 136*a* being coated with the blue-color fluorescent assistant material composition 132 and the void of another concave portion 130, with respect to the concave portions 130 of the composite forming mold 152. Since the injection method is the same as the method explained in FIG. 6C of the fifth embodiment, the detailed description thereof will be omitted.

Figure 8G:
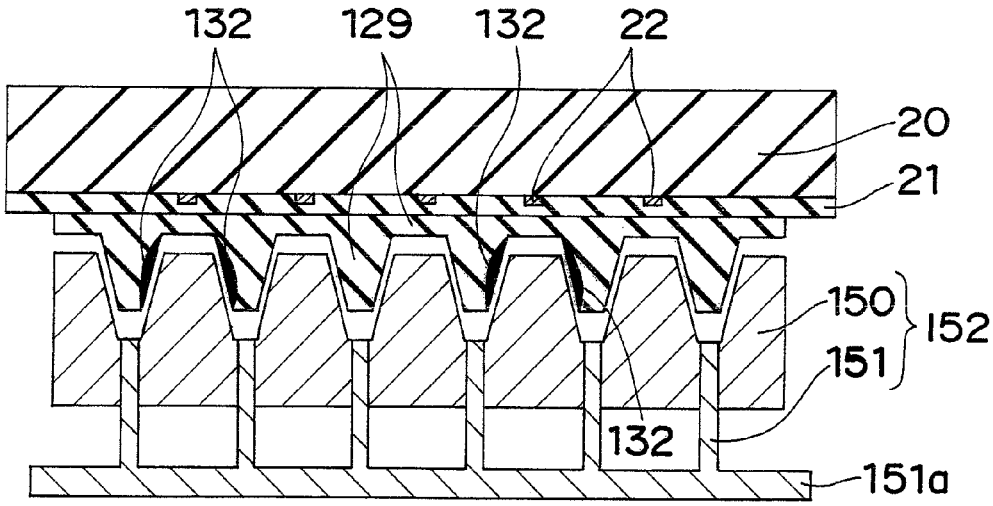
FIG. 8G is a view showing a manufacturing process of the back face panel in the PDP of the fifth embodiment of the present invention, which follows the process of FIG. 8F.
Figure 8H:
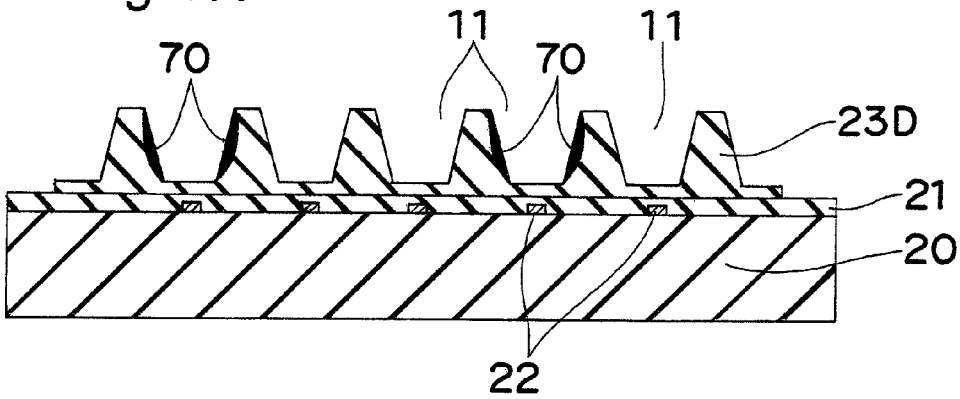
FIG. 8H is a view showing a manufacturing process of the back face panel in the PDP of the fifth embodiment of the present invention, which follows the process of FIG. 8G.
Figure 8I:
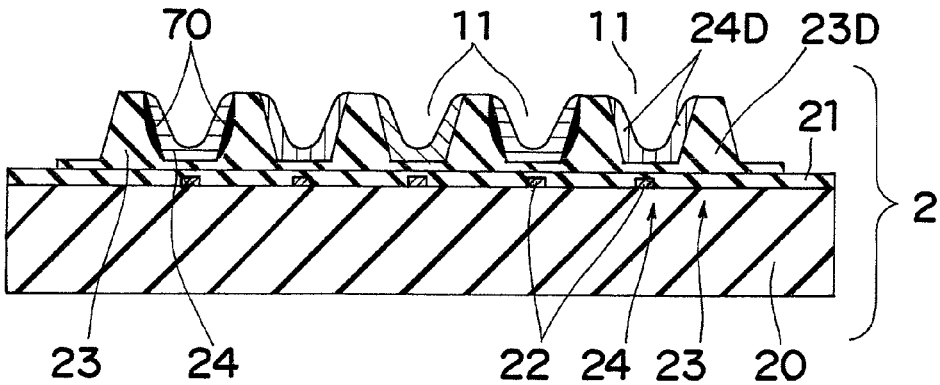
FIG. 8I is a view showing a manufacturing process of the back face panel in the PDP of the fifth embodiment of the present invention, which follows the process of FIG. 8H.

Next, following the step of injecting the barrier-rib material composition 129, the step of making the back face substrate 20 and the barrier-rib material composition 129 of the first forming mold 150 in contact with each other so that the back face substrate 20 and the barrier-rib material composition 129 of the first forming mold 150 are bonded to each other (in the same manner as in FIG. 6D, not shown in the Figures), the step of curing the fluorescent assistant material composition 132 and the barrier-rib material composition 129 (in the same manner as in FIG. 6E, not shown in the Figures), the step of mold-releasing the fluorescent assistant material composition 132 and the barrier-rib material composition 129 from the composite forming mold 152 (in the same manner as in FIG. 6F, as shown in FIG. 8G), the step of firing the fluorescent assistant material composition 132 and the barrier-rib material composition 129 (in the same manner as in FIG. 6G, shown in FIG. 8H), the step of injecting the paste-state blue-color phosphor material into discharge cells 11 corresponding to the barrier-rib portions 23D, with the blue-color fluorescent assistant layer 70 being formed on the side faces thereof, while the paste-state green-color and red-color phosphor materials are respectively injected into the other discharge cells 11 so that the phosphor portions 24D are respectively formed (in the same manner as in FIG. 6H, shown in FIG. 8I), are carried out so that the back face panel 2 is obtained. After the step of making the back face substrate 20 and the composite forming mold 152 in contact with each other, the same steps as those steps of FIGS. 6D to 6H in the third embodiment are carried out; therefore, the description thereof will be omitted.

The back face panel 2 thus formed makes it possible to achieve a PDP having basically the same effects as those shown in the third embodiment; however, by using the second forming mold 151, the fluorescent assistant material composition 132 can be more positively injected and applied only to the side faces of a predetermined concave portion 130 (in other words, with the position of the barrier-rib bottom face being controlled with high precision).

Here, the above-mentioned description has exemplified a structure in which only the blue-color fluorescent assistant material composition 132 is injected and applied thereto as the fluorescent assistant material composition 132; however, even in the case when a red-color or green-color fluorescent assistant material composition 132 is injected and applied to the respective side faces thereof, it becomes possible to achieve the back face panel 2 that is free from mixed colors of these.

Moreover, prior to the process of FIG. 8C, an oil repellent material such as zirconia is applied to the surface of the end portion 153 of the second forming mold 151 for forming the concave portions 130 so as to provide oil repellency to the surface of the end portion 153 of the second forming mold 151 so that during the process of applying the fluorescent assistant material composition 132, it is possible to prevent the fluorescent assistant material composition 132 adhered to the concave portion side face 136*a* from being further applied to the surface of the end portion 153 of the second forming mold 151.

In each of the above-mentioned various embodiments of the present invention, since the barrier rib 23 is made of a barrier-rib portion 23A to 23D comprising only a barrier-rib material and a fluorescent assistant material 66, 70 that is formed by mixing a fluorescent assistant material and the barrier-rib material, the barrier-rib strength is not lowered, and even in the case of a high precision device with a fine barrier-rib dimension, it becomes possible to increase the barrier-rib strength.

By properly combining the arbitrary embodiments of the aforementioned various embodiments, the effects possessed by the embodiments can be produced.

INDUSTRIAL APPLICABILITY

The present invention makes it possible to achieve a PDP that can increase the effective phosphor thickness, with the barrier-rib strength being properly maintained, and a manufacturing method for such a PDP, and the PDP is effectively applicable to an image display apparatus or the like having a large size with high precision.

Moreover, the present invention makes it possible to achieve a manufacturing method for a PDP that can improve the luminance of the phosphor layer without narrowing the discharge space, with the barrier-rib strength being properly maintained, and the method is effectively applicable to an image display apparatus or the like having a large size with high precision.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A plasma display panel comprising:

a front face panel prepared by forming paired display electrodes, a dielectric layer, and a protective layer on a glass substrate; and a back face panel prepared by forming, on a substrate, address electrodes, barrier ribs formed only by a barrier-rib material, and phosphor layers formed only by a phosphor material, with the front face panel and the back face panel being made face to face with each other to form discharge spaces by sealing peripheral portions thereof, wherein fluorescent barrier-rib portions are placed between the barrier ribs and each of the phosphor layers, with the fluorescent barrier-rib portions comprising a mixed material of a barrier-rib material and a phosphor material, and with the phosphor material having a mixed ratio in a range of from 42 wt % to 67 wt %.

* * * * *